US006903711B2

(12) United States Patent
Akiba

(10) Patent No.: US 6,903,711 B2
(45) Date of Patent: Jun. 7, 2005

(54) METHOD FOR DRIVING PLASMA DISPLAY PANEL

(75) Inventor: Yutaka Akiba, Fujisawa (JP)

(73) Assignee: Hitachi, Ltd., Tokyo (JP)

( * ) Notice: Subject to any disclaimer, the term of this patent is extended or adjusted under 35 U.S.C. 154(b) by 150 days.

(21) Appl. No.: 10/080,041

(22) Filed: Feb. 19, 2002

(65) Prior Publication Data

US 2002/0135545 A1 Sep. 26, 2002

(30) Foreign Application Priority Data

Mar. 26, 2001 (JP) ..... 2001-086639

(51) Int. Cl.[7] ..... G09G 3/28

(52) U.S. Cl. ..... 345/67; 345/66; 345/68; 313/581; 313/585; 315/161.1; 315/161.3; 315/169.4

(58) Field of Search ..... 345/60–63, 66–68; 313/245, 258, 243, 268; 315/169.1–169.4

(56) References Cited

U.S. PATENT DOCUMENTS 5,264,758 A 11/1993 Iijima et al.
6,317,105 B1 * 11/2001 Eo et al. ..... 345/68
6,400,342 B2 * 6/2002 Hirakawa ..... 345/60
6,414,658 B1 * 7/2002 Tokunaga ..... 345/53
6,417,824 B1 * 7/2002 Tokunaga et al. ..... 345/60
6,476,781 B1 * 11/2002 Suzuki et al. ..... 345/60
6,559,815 B1 * 5/2003 Kang et al. ..... 345/60

FOREIGN PATENT DOCUMENTS

| | | |
|---|---|---|
| JP | 10-241577 | 9/1998 |
| JP | 11-086737 | 3/1999 |
| JP | 11-312470 | 11/1999 |
| JP | 2000-223035 | 8/2000 |
| JP | 2000-306516 | 11/2000 |
| JP | 2001-084913 | 3/2001 |
| JP | 2001-266751 | 9/2001 |
| JP | 2001-266799 | 9/2001 |

* cited by examiner

*Primary Examiner*—Henry N. Tran
(74) *Attorney, Agent, or Firm*—Townsend and Townsend and Crew LLP

(57) ABSTRACT

In a driving method for driving a plasma display panel, achieving improvements on luminous efficiency, brightness and contrast, as well as, low voltage and low power consumption, and also high-speed addressing and sustain therewith, wherein onto a second display electrode is applied pulse voltage in reverse polarity with sustain pulse voltage, nearly in synchronism with the sustain pulse voltage to be applied onto a first display electrode, thereby shifting initial discharge (or, pre-charge) caused between the first display electrode and a metal electrode of a partition portion after the generation thereof into display discharge, thereby forming wall charge and wall voltage on the second display electrode.

16 Claims, 9 Drawing Sheets

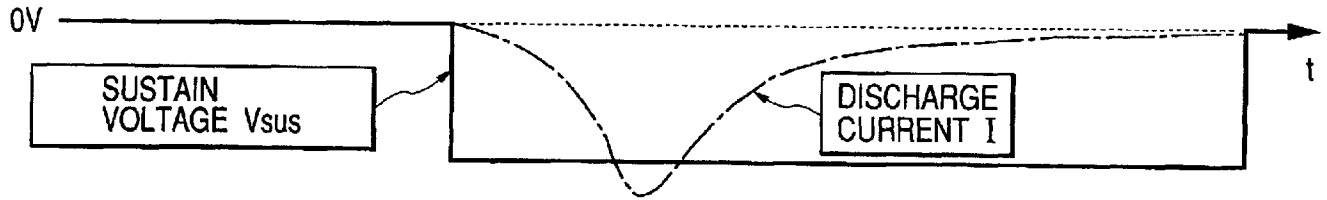
FIG. 5(a)
0V
t
SUSTAIN VOLTAGE Vsus
DISCHARGE CURRENT I

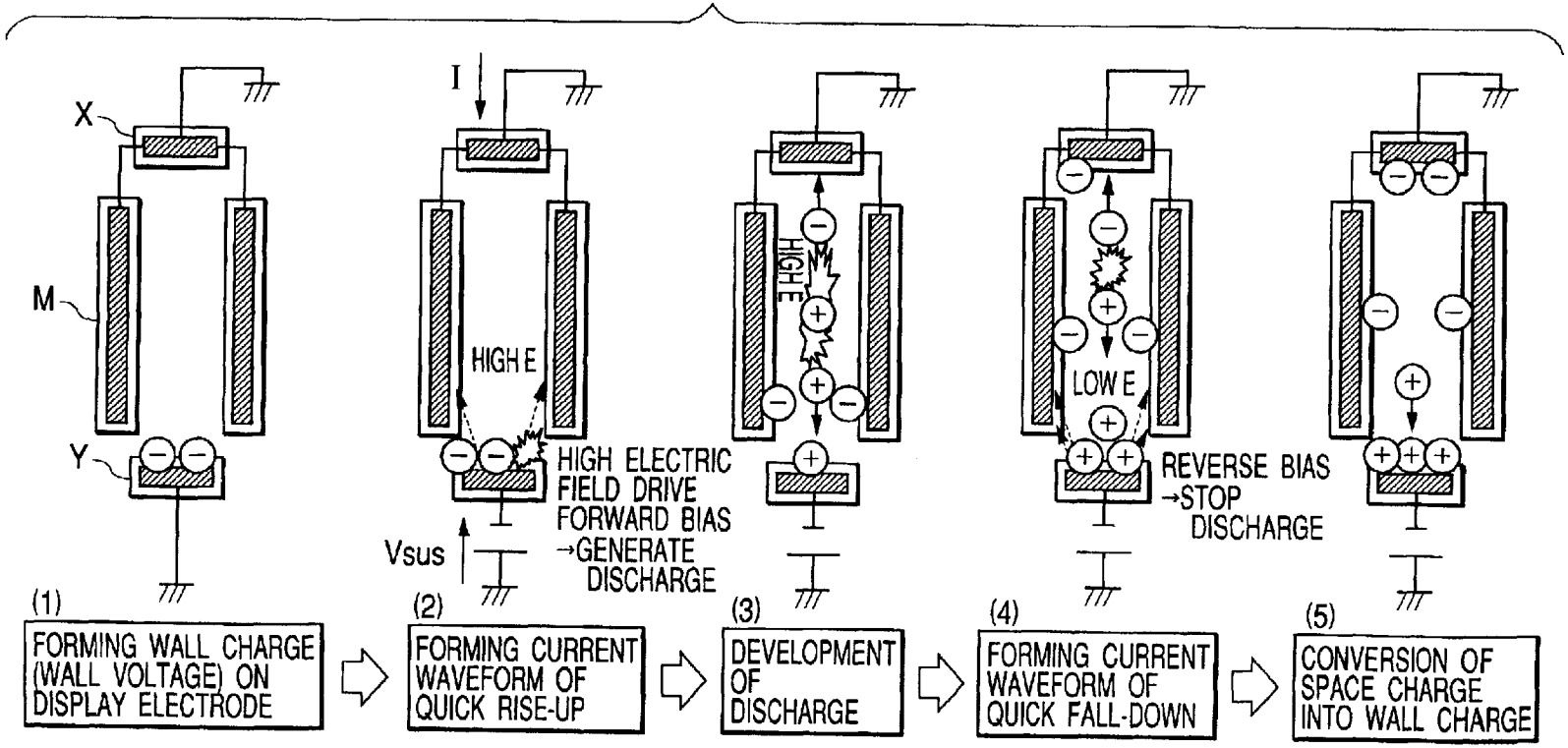
FIG. 5(b)
X
M
Y
(1) FORMING WALL CHARGE (WALL VOLTAGE) ON DISPLAY ELECTRODE
I
HIGH E
Vsus
(2) FORMING CURRENT WAVEFORM OF QUICK RISE-UP
HIGH ELECTRIC FIELD DRIVE FORWARD BIAS →GENERATE DISCHARGE
HIGH E
(3) DEVELOPMENT OF DISCHARGE
LOW E
REVERSE BIAS →STOP DISCHARGE
(4) FORMING CURRENT WAVEFORM OF QUICK FALL-DOWN
(5) CONVERSION OF SPACE CHARGE INTO WALL CHARGE

METHOD FOR DRIVING PLASMA DISPLAY PANEL

BACKGROUND OF THE INVENTION

1. Field of the Invention

The present invention relates to a method for driving a plasma display panel, and also a driving circuit and a display apparatus using thereof.

2. Description of Prior Art

Conventionally, in the structure of an AC type plasma display apparatus having three electrodes, for example, the display panel is built up with electrodes for use in addressing (i.e., address electrodes) and two (2) kinds of electrodes for use in discharging for display (i.e., X electrodes and Y electrodes) aligned within the same plane, but being disposed on the respective substrates opposing to each other, separately. In driving for displaying a picture thereon, after conducting initialization upon cells by applying initialization pulses onto the two (2) kinds of display electrodes (thus, the X electrodes and the Y electrodes), addressing is conducted corresponding to the picture signal, by applying both addressing pulses and scanning pulses, upon the basis of the picture signal, onto the address electrodes and the one of the display electrodes (thus, the Y electrodes), respectively. And, thereafter, with applying sustain pulses onto the two (2) kinds of the display electrodes (thus, the X electrodes and the Y electrodes), alternately or one by one, the display discharge is carried out, where the discharges must be sustained between the both electrodes.

In the conventional art mentioned above, because of such the structure that surface discharge is conducted between the two (2) kinds of display electrodes aligned within the same plane (thus, the X electrodes and the Y electrodes), sufficient luminous efficiency and/or brightness cannot be obtained therein. For the purpose of an increase in the brightness mentioned above, for example, voltage of the sustain pulses must be made high enough, therefore it results in an increase of electric power consumption, incidentally. On the other hand, for increasing up the luminous efficiency, the sustain pulse must be lowered, so as to reduce the space charge accumulated therein, therefore it is in the relationship conflicting with an improvement on the brightness. Accordingly, a problem to be solved by the present invention is, in details thereof, to improve both the brightness and the luminous efficiency at the same time, but without increasing the sustain voltage. In particular, in a case where a capacity between the electrodes, such as the address electrode and the display electrode is large, it brings about upraise in the sustain pulse, thereby ending up to an increase of the electric power consumption.

Reduction in the contrast is caused mainly due to a factor of luminous discharge occurring during the time-period when all write-in is carried out for each sub-filed. Other problem to be solved by the present invention is, in more details, to realize the all write-in without causing such the luminous discharge, or reduction in the number of the occurring luminous discharges.

SUMMARY OF THE INVENTION

An object is, according to the present invention, to provide a method for improving the brightness and the luminous efficiency, which can be considered to be difficult in the conventional art. Furthermore, other object according to the present invention is to provide a method for improving the contrast, so as to obtain an advance in the picture quality obtained thereby.

For example, the objects according to the present invention are; (1) to obtain an improvement on both the luminous efficiency and the brightness, at the same time, even if applying sustain voltage at a predetermined level, (2) to obtain an improvement on the contrast, without generating the luminous discharge upon the all write-in operation, and (3) to obtain reduction in the sustain voltage by applying a driving method upon which the capacitor between the electrodes hardly gives ill influence.

On an outline of the representative ones of the present invention, being disclosed in the present application for accomplishing the objects mentioned above, a brief explanation is as follows.

According to the present invention, for accomplishing the object mentioned above, there is provided a driving method for a plasma display panel having an address electrode, a first display electrode formed on said address electrode, a second display electrode formed on a surface opposing to said the first display electrode, and a partition wall formed between said first display electrode and said second display electrode, comprising the following steps: a first step for conducting addressing operation for each sub-field; and a second step for conducting sustaining operation for display upon basis of a result of said addressing, wherein, in said second step, onto said second display electrode is applied pulse voltage differing in polarity and nearly in synchronism with first sustain pulse voltage to be applied onto said first display electrode, thereby forming space charges generated after discharge between said address electrode and said first display electrode in form of wall charge on said second display electrode. Furthermore, said partition wall has a metal electrode therein.

Also, according to the present invention, there is provided a driving method for a plasma display panel having an address electrode, a first display electrode formed on said address electrode, a second display electrode formed on a surface opposing to said the first display electrode, and a partition wall formed between said first display electrode and said second display electrode and including a metal electrode therein, comprising the following steps: a first step for plural numbers of sub-fields to conduct all write-in, respectively; a second step for conducting addressing operation; a third step for conducting sustaining operation; and a fourth step for conduction erase operation, wherein, in said first step, wall charge is formed through initial discharge caused by applying pulse voltages onto said address electrode and said first display electrode, respectively, and by causing self-erase discharge after said pulse voltages are removed, wall charge is formed by applying voltages onto said address electrode and said first display electrode, respectively; in said second step, address pulse voltage is applied onto said address electrode upon basis of the picture signal, nearly in synchronism with scan pulse voltage onto said first display electrode, so as to remove said wall charge without accompanying luminous discharge, thereby selecting a non-luminous cell(s); in said third step, onto a luminous cell(s) selected through forming said wall charge, short-pulse voltage is applied onto said address electrode and sustain pulse voltage onto said first display electrode, so as to cause pre-discharge, and thereafter, by means of sustain pulse voltages applied onto said first display electrode and said second display electrode alternately, display luminous discharge is repeated through the initial discharge between said metal electrode grounded to the earth, thereby applying a last sustain pulse voltage onto said second display electrode; and in said fourth step, only onto said first display electrode, or onto said first display electrode and said address electrode, respectively, thin-line short pulse voltage is applied, thereby causing discharge for erasing the wall charges between said metal electrode, said address electrode, and said second display electrode.

And, also, according to the present invention, there is further provided a display apparatus comprising: a plasma display panel, having a metal electrode disposed between first and second display electrodes (Y electrode, X electrode), each having a portion crossing with and in nearly parallel with an address electrode (A electrode), and partition wall provided in a lattice-like from; and a driver circuit for the plasma display panel, which is described in the above.

Explanation will be given in more detail upon means for dissolving the problems mentioned above.

(1) First, the means for improving both the luminous efficiency and the brightness, at the same time, as a first problem to be solved by the present invention.

With increase in the sustain voltage, the discharge energy rises up, and thereby ionized gas within the cell is increased. Due to this, the electric field intensity is lowered down, and therefore discharge efficiency, thus, the luminous efficiency $\eta$ is lowered down. For reducing the ionized gas within the cell, there is a necessity of a method for decreasing the ionized gas (i.e., an amount of mobile electric charge Qc) itself, which is generated in the discharge, or for reducing it through converting the ionized gas (i.e., the amount of mobile electric charge Qc) into wall charge Qw ($Qc=2Qw=2(Qw_{+}+Qw_{-})$).

In the former case, the ionized gas is in proportion to electric energy ($CV^2$) when discharging, and it can be decreased down by lowering the sustain voltage |vsus|, for example. On the other hand, from a viewpoint of driving an AC type PDP, the sustain voltage |Vsus| must be larger than the voltage for maintaining discharge (i.e., discharge maintaining voltage) for the voltage, including the wall voltage (i.e., |Vsus|+Vw) therein, to maintain the discharge. Accordingly, under the consumption that the discharge maintaining voltage ruled by the electrode structure is constant, for decreasing the sustain voltage |Vsus|, it is necessary to rise up the wall voltage Vw by an amount of decrease in the sustain voltage |Vsus|. In general, this wall voltage Vw is formed by the wall charge Qw ($=C_0\cdot|Vsus|$). For increasing the wall voltage Vw and the wall charge Qw, in addition to the sustain voltage |Vsus|, newly voltage Vn1 is needed for increasing up the wall charge Qw. This voltage Vn1 is determined under presumption that it gives no ill influence upon the electric energy when discharging. Thus, the problem to be solved by the present invention is, under such the presumption, to provide a means for bringing the wall charge Qw to $C_0\cdot(|Vsus|+Vn1)$, and the wall voltage Vw to (|Vsus|+Vn1), respectively.

In the other case, i.e., the latter, the problem lies in the case where the ionized gas is too much. For the solving means to remove or reduce the ionized gas, without accompanying the decrease in luminous efficiency, it is necessary, not to make them loss through the neutralization or the like, but to convert them into the wall charge Qw for recycling or re-use thereof (i.e., for accumulation of ionization energy). In general, the wall charge Qw is formed by Qw ($=C_0\cdot|Vsus|$). Thus, the wall voltage Vw is formed, so that it brings the sustain voltage |Vsus| at the maximum value. Accordingly, for building up the wall charge Qw further, in addition to the sustain voltage |Vsus|, newly voltage Vn2 comes to be necessary for increasing up the wall charge Qw. This voltage Vn2 is also determined under the presumption that it gives no ill influence upon the electric energy ($CV^2$) when discharging. Thus, the problem to be solved by the present invention is, under such the presumption, to provide a means for bringing the wall charge Qw to $C_0\cdot(|Vsus|+Vn2)$, and the wall voltage Vw to (|Vsus|+Vn2), respectively.

The concrete means for solving the above is provided by a driving method, arising from such the electrode construction of the newly structured PDP, where the voltages Vn1 and Vn2 are newly introduced herein, and under such the presumption of giving no ill influence upon the electric energy when discharging.

As will be shown in FIGS. 2, 3 and 8, which will be mentioned later, in the electrode structure having a discharge passage formed in an "I" or in reverse "U" shape, differing from the conventional structure, a metal partition wall (i.e., a metal electrode: M electrode) lies between the first display electrode (i.e., the Y electrode) and the second display electrode (i.e., the X electrode). In the driving method during the period of display light-emission, negative sustain pulse voltage |Vsus| is applied onto the X and Y electrodes, alternately, while the M electrode is in an anode drive of being always grounded to the earth. Since the sustain voltage |Vsus| is applied onto one of the X and Y electrodes and onto the M electrode, i.e., between X-M or Y-M, therefore the one of the display electrodes opposing thereto does not contribute to the energy when discharging directly. Thus, the present invention differs from the conventional structure, basically, in that the sustain voltage gives the ill influence upon the discharge energy since it is applied directly between the X-Y electrodes in the conventional one. In the above-mentioned electrode structure having such the discharge passage formed in the "I" or the reverse "U" shape, since the voltage Vn1 used for forming the wall charge Qw after the discharge is applied onto an opposite electrode of the anode drive in the form of positive pulse voltage, it is possible to further increase the negative charge $Qw_{-}$ and the negative voltage Vw. The wall voltage Vw increases up to (|Vsus|+Vn1) when the polarity thereof is reversed, and therefore it is possible to reduce the sustain voltage |Vsus| by an amount of the increase therein. Further, since the sustain voltage |Vsus| can be lowered greatly, but with maintaining the stable discharge, it is also possible to obtain an effect of widening the operation margin in the sustain voltage by means of the voltage Vn1.

In this instance, since the voltage Vn1 converts the ionized gas generated by the discharge into the wall charge at the same time, it has the property or characteristic of the new voltage Vn2 in common. Accordingly, the voltage Vn1 and the voltage Vn2 can be given by the same pulse voltage.

From the above, the voltage Vn (Vn1=Vn2=Vn) can provide a means for lowering the sustain voltage |Vsus|, and at the same time, for converting the ionized gas (i.e., discharge energy) into the wall charge, thereby reducing the loss due to the neutralization thereof.

Namely, for example, as will be shown in FIGS. 7 and 9 which will be mentioned later, the object can be achieved by a driving method, wherein onto the second display electrode (i.e., the X electrode) is applied pulse voltage Vx1, or Vx1 and Vx3, being different in polarity and in nearly synchronism with the sustain pulse to be applied onto the first display electrode, thereby forming the space charge generated after the discharge between the address electrode (i.e., the A electrode) or the metal electrode (i.e., the M electrode)

and the first display electrode (i.e., the Y electrode) in the form of the wall charge on the second display electrode (i.e., the X electrode), and also onto the first display electrode (i.e., the Y electrode) is/are applied pulse voltage(s) Vy5, or Vy5 and Vy8, being different in polarity and in nearly synchronism with the sustain pulse to be applied onto said second electrode (i.e., the X electrode), thereby forming the space charge generated after the discharge between the second display electrode (i.e., the X electrode) and the metal electrode (i.e., the M electrode) in the form of the wall charge on the first display electrode (i.e., the Y electrode).

With this, the sustain voltage to be applied onto the X and Y electrodes can be decreased, and by using the ionized gas (i.e., discharge energy) within the cell in the form of the wall charge, the discharge efficiency, i.e., the luminous efficiency $\eta$ is increased up under an appropriate amount of mobile charge Qc, but without decrease of the intensity of electric field. At the same time, since the wall voltage Vw formed by the wall charge is added to the sustain voltage |Vsus|, the high brightness B can be also maintained.

In case of the PDP having the discharge passage of the "I" type which will be shown in FIGS. 2 and 3, due to asymmetry in the electrode structure of X and Y, an amount of the wall charge Qw (i.e., the wall voltage Vw) generated when discharging differs basically. For adjusting this, as the voltage Vn for reducing the sustain voltage |Vsus|, it is used as Vx1 and Vx3 to be applied onto the second display electrode, i.e., the X electrode, as will shown in FIG. 1 mentioned later. Thus, the X electrode is a plane electrode and large in electrode area, therefore, in general, has a certain degree in the concentration of electric field, being smaller than that of the Y electrode. This is because, in general, the wall charge Qw necessary for generating a certain wall voltage Vw is larger at the X electrode side, due to balance of the driving condition.

On a while, in case of the PDP having the discharge passage of the reverse "U" shape which will be shown in FIG. 8, due to the symmetry in the electrode structure of X and Y, an amount Qw of generation of the wall charge when charging comes to be equal, in general. Accordingly, the voltage Vn used for reducing the sustain voltage |Vsus| brings the wall voltage in balance, by applying the positive pulse voltage(s) Vx, or Vx1 and Vx3 onto the X electrode and the positive pulse voltage(s) Vy5, or Vy5 and Vy8 onto the Y electrode, respectively.

(2) Next, in the electrode structure which will be shown in FIGS. 2, 3 and 8, for the basic four (4) periods, which make up a sub-field waveform, including, all write-in, address, sustain and erase, means will be taken up for (1) improving the contrast and decreasing electric power consumption, (2) achieving a low voltage address drive, and (3) obtaining a drive of less dependency upon the capacity between the electrodes, and reduction in the sustain voltage, as well.

In the all write-in period, positive and negative pulse voltages, each having a relatively long pulse width (equal to 10 $\mu$sec or more), are applied between Y and A electrodes, respectively, thereby generating an initial discharge. After the discharge, by means of the wall charge Qw and the wall voltage Vw formed between A-Y electrodes, self-erase discharge is generated in a pulse suspension period during when the voltage is removed away: i.e., within 10 $\mu$sec. And, bias voltages $V_A$ and $V_Y$ are applied onto cross electrodes of A and Y, so as to bring positive and negative charged particles in the form of the wall charge Qw (the wall voltage Vw) for all of the cells, thereby completing the all write-in. In this case, except for the first sub-field waveform, it is not necessary to generate the initial discharge in the all write-in period every time. With setting the positive and negative pulse voltages in the all write-in period just after the erase period that will be mentioned later, it is possible to utilize the charged particles generated by the thin-line pulse, thereby forming the wall charge Qw (and the wall voltage Vw) necessary for self-erase discharge without generation of the initial discharge. With this, the initial discharge of the all write-in can be achieved by only one (1) time of the first sub-field, thereby improving the contrast greatly.

In the address period is applied a method, in which the wall charge Qw formed in the all write-in period is erased between A and Y electrodes, thereby to select the lights-out cell. The wall charge Qw formed upon the same plane on the cross electrodes can be erased by voltage applied, being lower than the discharge voltage (i.e., the lights-out voltage). Thus, not due to the discharge, but the wall charge is erased by surface current through insulation resistance on the surface. Because of no accompany of light-emission therewith, it contributes much toward an improvement on the contrast of the lights-out cells. Also with decreasing greatly the capacity between A-Y electrodes which will be shown in FIGS. 2, 3 and 8, since a gap is short between the electrodes and the charge can be erased on the same plane in the electrode structure, essentially can be obtained high-speed address in addition to the low voltage address.

In the sustaining period, a light cell, being applied with the negative sustain voltage |Vsus| from the Y electrode selected, starts repetitive discharge. As was mentioned previously, for making the stability of discharge sure, a positive short pulse (i. e., the pulse width of 1.0 $\mu$sec) is applied onto the A electrode, so as to generate pre-charge between A-Y electrodes, thereby shifting into the display discharge between X-Y electrodes. In this instance, the metal partition wall (i.e., the metal electrode) is grounded to the earth, i.e., in the anode drive, thereby achieving narrow pulse discharge for providing the high brightness and the high luminous efficiency, as well. In particular, the pulse width of the initial first pulse or second pulse is long from a viewpoint of the stability of discharge, thereby to ensure the wall charge Qw (i.e., the wall voltage Vw). In the repetitive discharge between X-Y electrodes, the initial discharge (i.e., the pre-charge) is generated between the M electrode when discharge begins between X-Y electrodes, so as to develop the discharge between the respective opposite electrodes, i.e., X-Y electrodes, with maintaining the high electric field.

Also, for removing strain in the rise-up waveform due to the capacity Cay between A-Y electrodes for the pulse voltage onto the Y electrode, which forms the cross electrodes together with A electrode, onto the A electrode is applied pulse voltage, which is in-phase with the pulse voltage on the Y electrode and it has an amplitude less than a half thereof.

Further, for satisfying the discharge condition by the negative thin-line pulse used in the coming erase period, negative wall charge (i.e., the wall voltage) is formed by applying the last sustain pulse voltage of the repetitive discharge onto the X electrode.

In the erase period, basically, applying the negative thin-line pulse onto the Y electrode generates only the initial discharge between the M electrode, which occurs when the repetitive discharge is conducted, thereby neutralizing the charged particles. With this, the charge is erased upon the A electrode disposed on the Y, M and/or in the vicinity thereof.

On the other hand, in some cases, the charged particles (i.e., the ionized gas) generated in the erase period may be recycled or re-used for the purpose of an improvement of the contrast, but not be neutralized. Thus, the initial discharge generated by the thin-line pulse, as was mentioned previously, is used in common with the initial discharge caused by the pulse voltage applied onto the both A-Y electrodes in the all write-in period of the sub-field coming thereafter. Setting the time distance between the thin-line pulse voltage and the pulse voltage on the both A-Y electrodes within 50 μsec enables the charged particles generated by the thin-line pulse to be brought in the form of the wall charge on the both A and Y electrodes, but without accompanying neutralization thereof. For forming the wall charge with high efficiency, it is preferred to make the time distance as small as possible. With this, because of no necessity of generation of the initial discharge in the all write-in for each of the sub-fileds, the brightness in the black display comes down, thereby achieving a great improvement on the darkroom contrast. As a matter of course, the first initial discharge is necessary in at least one of the plural numbers of sub-fields. For the purpose of generation of this discharge, it is necessary to rise up the pulse voltage on the both A-Y electrodes at the first time (i.e., the sum in absolute value of the pulse voltages applied onto the both electrodes), or to apply the short pulse voltage (i.e., the thin-line pulse voltage) onto the both A-Y electrodes for satisfying the discharge condition before the pulse voltage is applied onto the both A-Y electrodes at the first time, separately. Namely, the above can be achieved by a driving method, in which, for example, in the all write-in period of at least one sub-field of the plural numbers thereof, respectively, onto the above-mentioned address electrode (i.e., the A electrode) and the above-mentioned first display electrode (i.e., the Y electrode) are applied short pulse voltages, being different in polarity and generating the space charge via the initial discharge, and also long pulse voltages, being different in polarity and forming the wall charge, sequentially, so as to generate the self-erase discharge after the removal of the long pulse voltage, and then voltages are applied onto the address electrode (i.e., the A electrode) and the first display electrode (i.e., the Y electrode) mentioned above, respectively, thereby forming the wall charge.

From the above, in the all write-in period, except for at least one of the sub-field of the plural numbers thereof, due to collaboration with the erase period, the contrast can be improved by only using the self-erase electrode, but without generating the initial discharge. In the address period, selection of the lights-out cell by using the method of erasing the wall charge, and also by using the surface current accompanying with no light-emission in the place of the discharge current, with fully utilizing the structure that the A and Y electrodes are formed on the same plane, enables to obtain the high-speed address with a low voltage address, and further to realize the improvement on the contrast of the lights-out cells. In the sustaining period, as was mentioned in the above, the positive short pulse is used for or applied to the A electrode, thereby improving the stability (i.e., the operation margin) of the display luminous discharge. Furthermore, the metal partition is in the anode drive of being grounded to the earth, thereby realizing the narrow pulse discharge with using a long gap, which brings about the high brightness and the high luminous efficiency.

BRIEF DESCRIPTION OF THE DRAWINGS

Those and other features, objects and advantages of the present invention will become more apparent from the following description when taken in conjunction with the accompanying drawings wherein:

FIGS. 5(*a*) and 5(*b*) are views for explaining the principle of the surface discharge;

DETAILED DESCRIPTION OF PREFERRED EMBODIMENTS

Hereinafter, embodiments according to the present invention will be fully explained by referring to the attached drawings.

FIGS. 1 to 6 are views for explaining a first embodiment according to the present invention.

Figure 1:
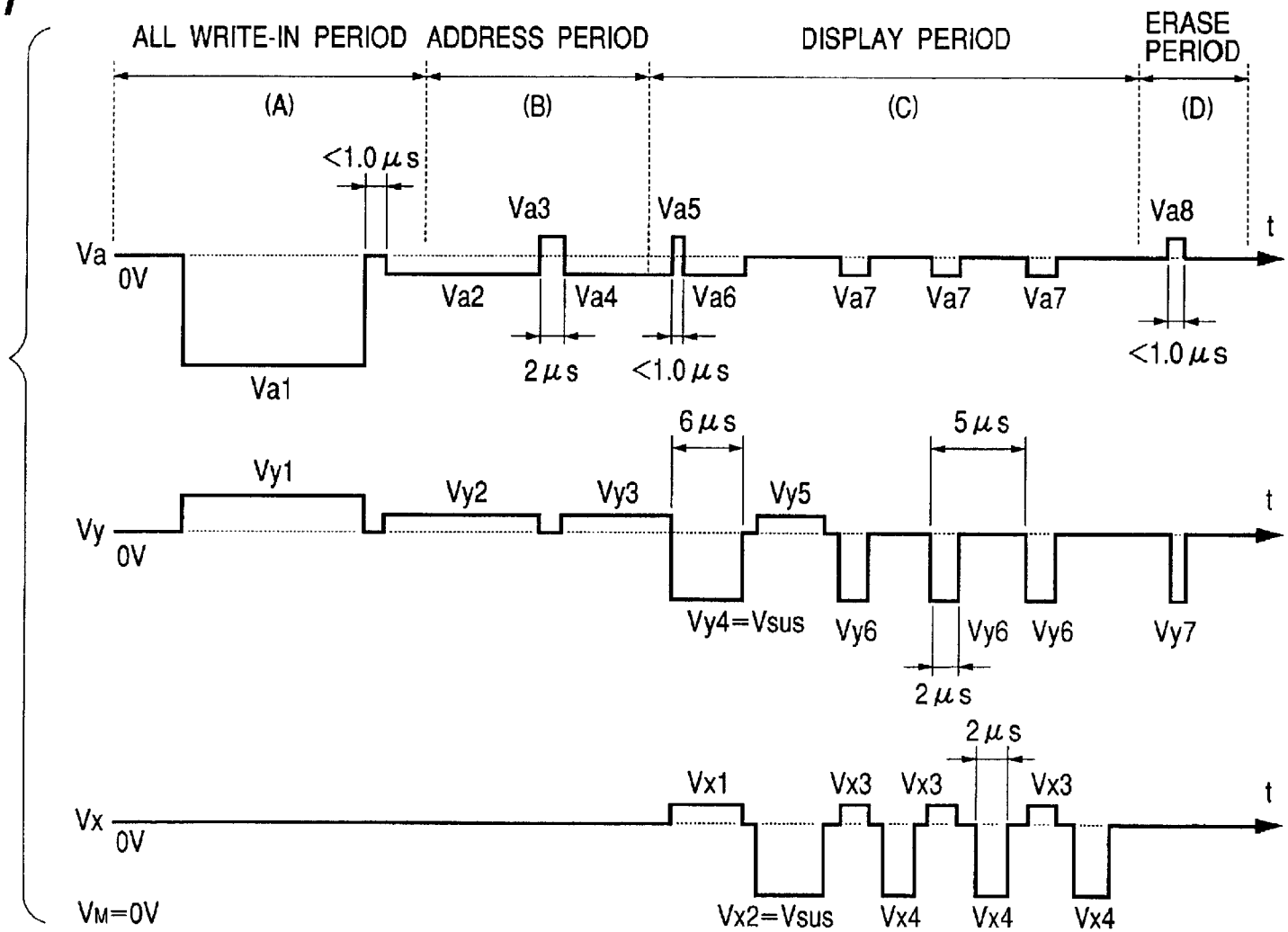
FIG. 1 is a view for showing an example of driving waveforms used in a first embodiment according to the present invention.
Figure 2:
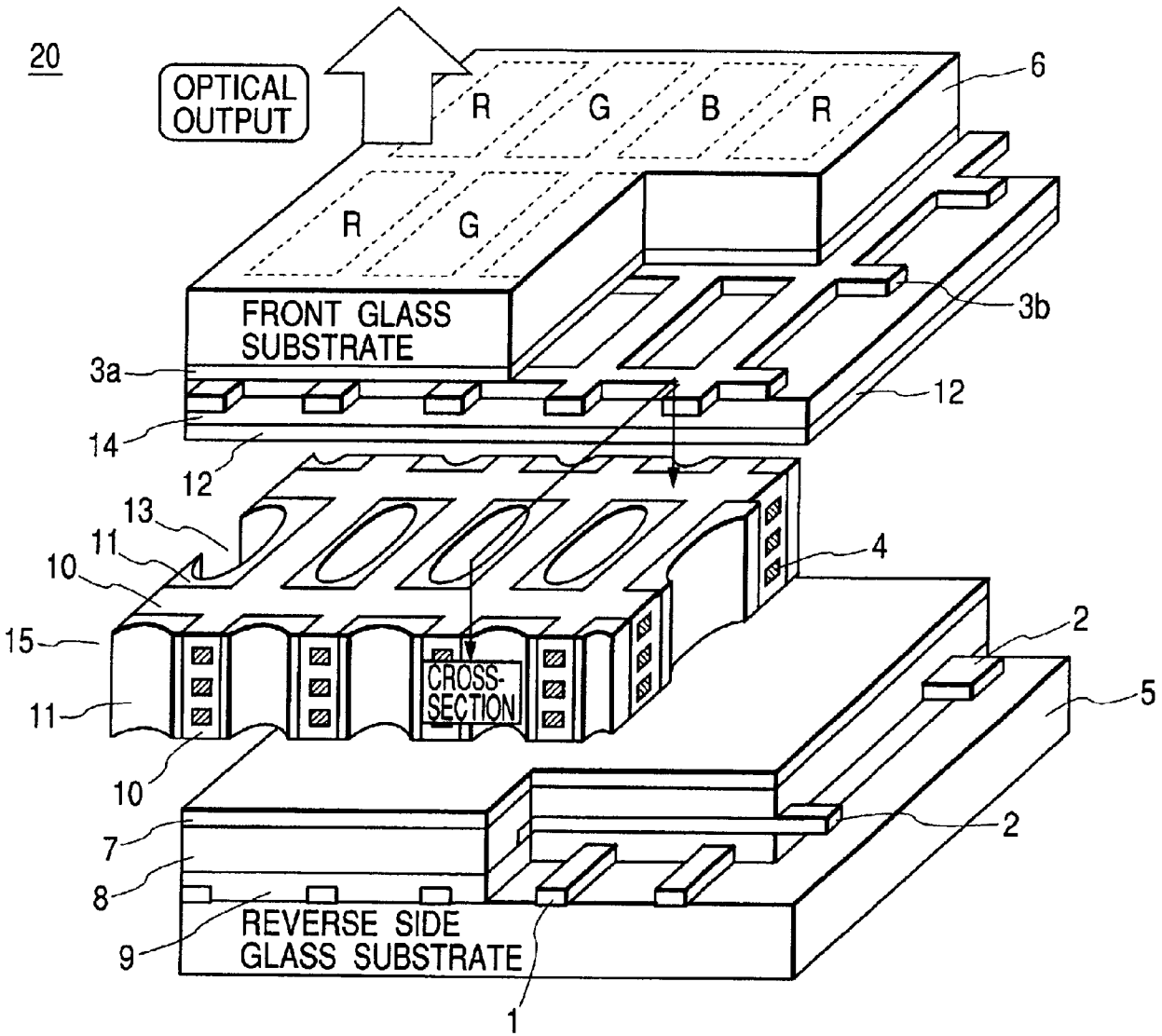
FIG. 2 is the structural view of a plasma display panel, which is used in the embodiment according to the present invention.
Figure 3:
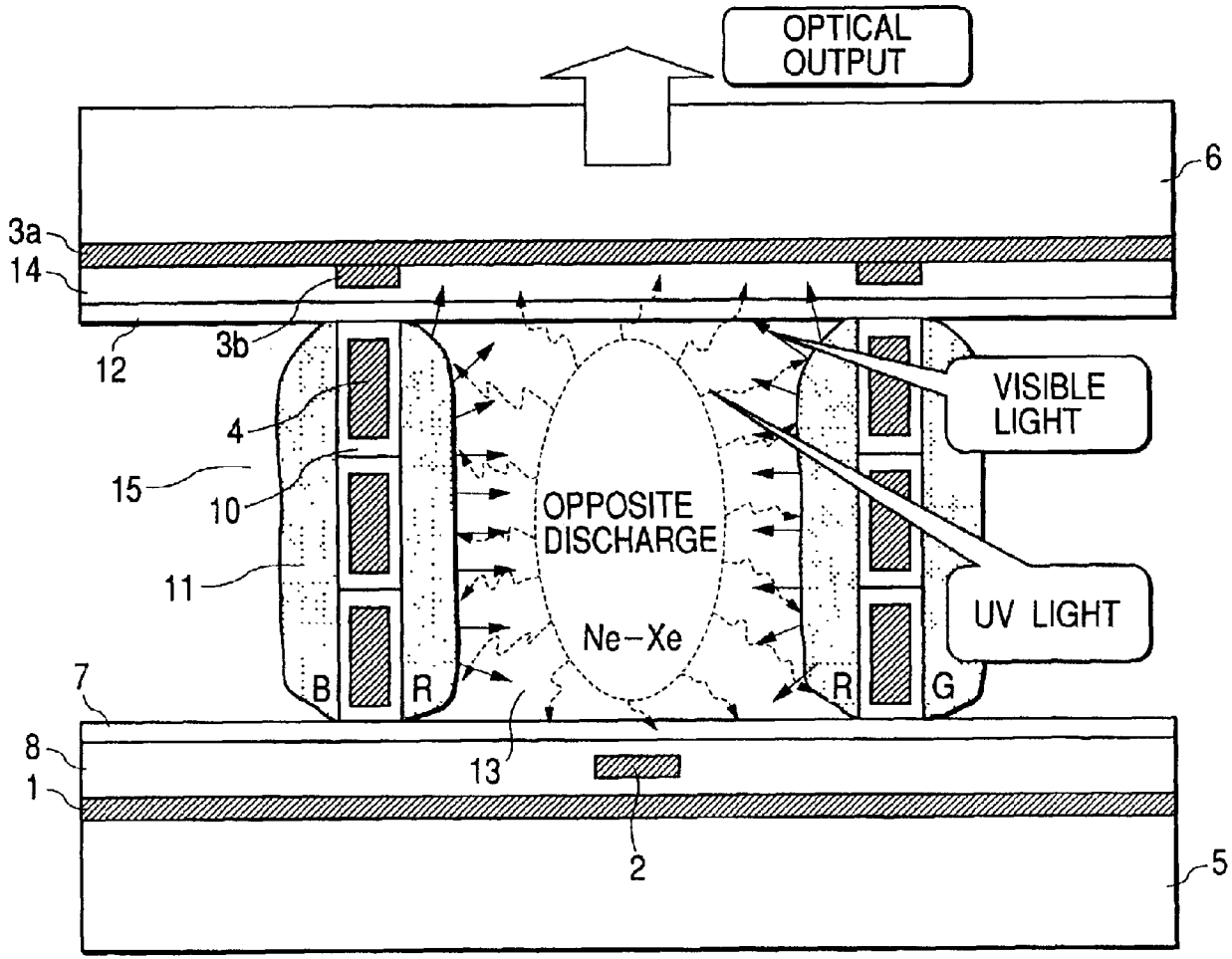
FIG. 3 is a cross-section view of the plasma display panel shown in the FIG. 2.
Figure 4:
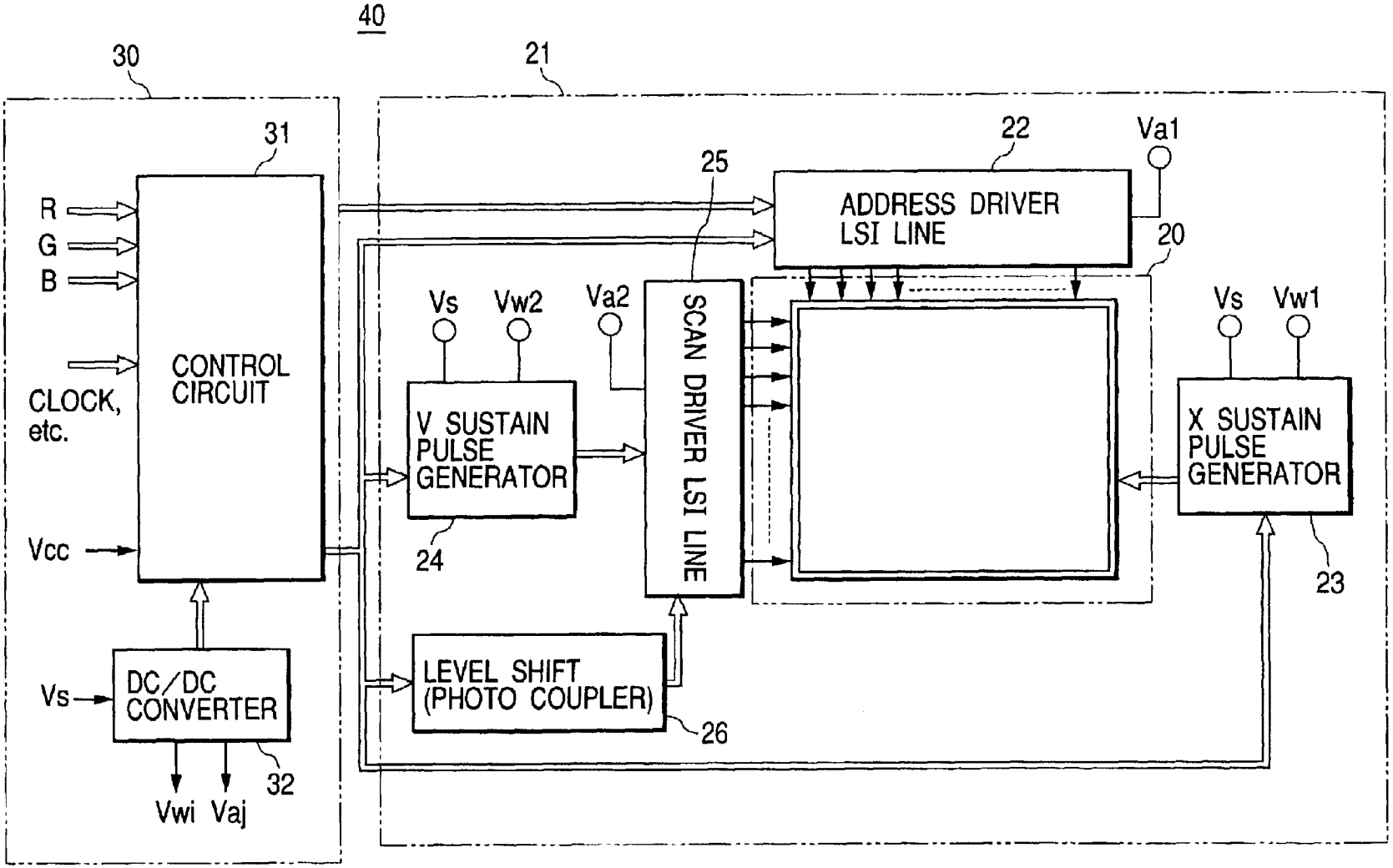
FIG. 4 is the structural view of a display apparatus having the plasma display.

FIG. 1 is a view of driving waveforms; FIG. 2 a perspective view of a plasma display panel; FIG. 3 is a cross-section of that panel; FIG. 4 the structural view of a display apparatus having the plasma display panel; FIGS. 5(*a*) and 5(*b*) views for explanation on the principle of the display discharge; and FIG. 6 a view for showing the operation margin between addressing voltage and sustain voltage in the display of static picture.

The present embodiment is an embodiment for carrying out the panel driving with using novel driving waveforms.

In FIG. 2, a reference numeral 1 indicates address electrodes for conducting addressing; 2 first display electrodes (i.e., Y electrodes) for conducting display, being provided intersecting with the address electrodes 1 at about right angles; 3*a* a flat electrode of second display electrodes (i.e., X electrodes) for conducting display in collaboration with the first display electrodes 2, being formed from a light-transmission member or material in a plane-like shape; 3*b* a so-called buss electrode of the second display electrodes (i.e., the X electrodes) for conducting display in collaboration with the first display electrodes 2, in the same manner as the flat electrode 3*a*, being formed to have a portion nearly in parallel with the first display electrodes 2; 15 a partition wall having a lattice-like structure, being provided between the plane of the first display electrodes (i.e., the Y electrodes) and the plane of the second display electrodes (i.e., the X electrodes); 4 metal electrodes provided within the partition wall; 5 a reverse-side glass substrate; 8, 9, 10 and 14 dielectric layers; 11 a fluophor layer; 7 and 12 protection films formed by using MgO film, $Y_2O_3$ film, or $RuO_2$ film, etc.; and 13 display cell portions, in each of which a luminous gas is enclosed, such as, Ne—Xe6% or the like. The above-mentioned address electrodes 1, the first display electrodes (i.e., the Y electrodes) 2 and the second display electrodes (i.e., the X electrodes) 3*a* and 3*b* are so structured that positive or negative voltage or zero voltage can be applied thereto, respectively, and the above-mentioned metal electrodes 4 are grounded to zero (0) potential.

FIG. 3 shows the cross-section view along with arrows in the structure shown in the FIG. 2. Conditions of UV (ultraviolet) light and visible light rays are shown therein, when display discharge occurs in the display cell portion 13 for R (red) light. The partition wall 15 is located at a position where the metal electrodes 4 nearly confront with the bus electrode 3*b* of the second display electrode, so that the display cell portion 13 is not reduced in the numerical aperture thereof, and at the middle portion thereof is formed the display cell portion 13. The first display electrode (i.e., the Y electrode) is disposed at the position opposite to around the central portion of the display cell portion 13. In the present configuration, the metal electrodes 4 are built up with plural numbers of metal sheets, on each surface of which is provided the dielectric film 10, and further on the surface at the side of the display cell portion 13 is provided the fluophor corresponding to R-light. In the neighboring display cell portions, but separated by the partition wall therebetween, fluophors are provided corresponding to B (blue) light and G (green) light, thereby forming the display cell portions for use of B-lihgt and G-light, respectively.

In such the structure, address (write-in) operation is carried out, by applying voltages to the address electrode 1 and the first display electrode (i.e., the Y electrode) building up a cross-electrode structure, respectively, while display operation is by applying negative pulse voltages onto the first display electrode (i.e., the Y electrode) 2 and the second display electrode (i.e., the X electrode), alternately. In this instance, the metal electrodes 4 are always grounded to the earth and are driven by an anode (i.e., in the condition of an anode drive), and it forms a short gap in spite of a long gap defined between the X and Y electrodes, therefore generating high electric field with low voltage. Effectively, the above builds up a three (3) electrode drive of X, Y and A.

In FIG. 1 is shown an example of a driving technology, as a first embodiment of the present invention, especially, in the case of driving the plasma display panel shown in the FIGS. 2 and 3 by an AC type driving. As driving waveforms are shown a driving waveform of the address electrode (i.e., the A electrode) and two (2) driving voltage waveforms of the two (2) electrodes (i.e., the X and Y electrodes) during the time-period of one (1) sub-field. In the FIG. 1, "Va" indicates a drive voltage to be applied onto the address electrode, "Vy" a drive voltage onto the first display electrode, "Vx" a drive voltage onto the second display electrode, and "$V_M$" onto the metal electrode (i.e., the M electrode). The present first embodiment is an example, including: an all write-in period ((A)) for forming wall charge to all of the cell electrodes of A and Y; an address period ((B)) for selecting the display cell portion(s) to be lighten by changing the condition of that wall charge upon the basis of a picture or video signal (=addressing); a display period ((C)) for making the display cell portion(s) in accordance with the selection condition (thus, the result of selection); and an erase period ((D)) for removing the charges on each of the electrodes through discharge of thin-line pulse voltage, in the time-period of one (1) sub-field. In the present first embodiment, the metal electrode M mentioned above is always grounded to the earth, and the $V_M$ is at 0 v.

(A) In the all write-in period, (1) while applying pulse voltage Va1 onto the address electrode, pulse voltage Vy1 is applied onto the first display electrode, thereby generating initial discharge; (2) after the initial discharge, the voltage on the first display electrode is turned to zero (0), thereby causing self-erasing discharge; (3) after the self-erasing discharge, while applying pulse voltage Va2 onto the address electrode, pulse voltage Vy2 is applied onto the first display electrode, thereby forming or building up the wall charge (i.e., conducting the write-in on the all cells).

(B) In the address period, (1) Following the write-in period mentioned above, pulse voltage Va2 is applied onto the address electrode, and also pulse voltage Vy2 is applied onto the first display electrode, thereby sustaining the wall charge; (2) address pulse voltage Va3 is applied onto the address electrode so that the wall charge is erased by the combination with the Y scan operation onto the first display electrode, upon the basis of the picture signal, thereby selecting the display cell(s) (or, non-display cell) without accompanying the luminous discharge; (3) and thereafter, while applying pulse voltage Va4 onto the address electrode, pulse voltage Vy5 is applied onto the first display electrode, there by maintaining the condition of the wall charge, again. Since the luminous discharge does not occurs, address can be obtained with low voltage, and at the same time, also the pulse width can be reduced, thereby achieving both low voltage addressing and high speed addressing at the same time. In the above (2), the wall charge is erased by applying the address pulse voltage Va3, thereby performing the address of a lights-out cell; thus, selecting the cell not allowed to emit light upon the sustain pulse during the display period.

Figure 8:
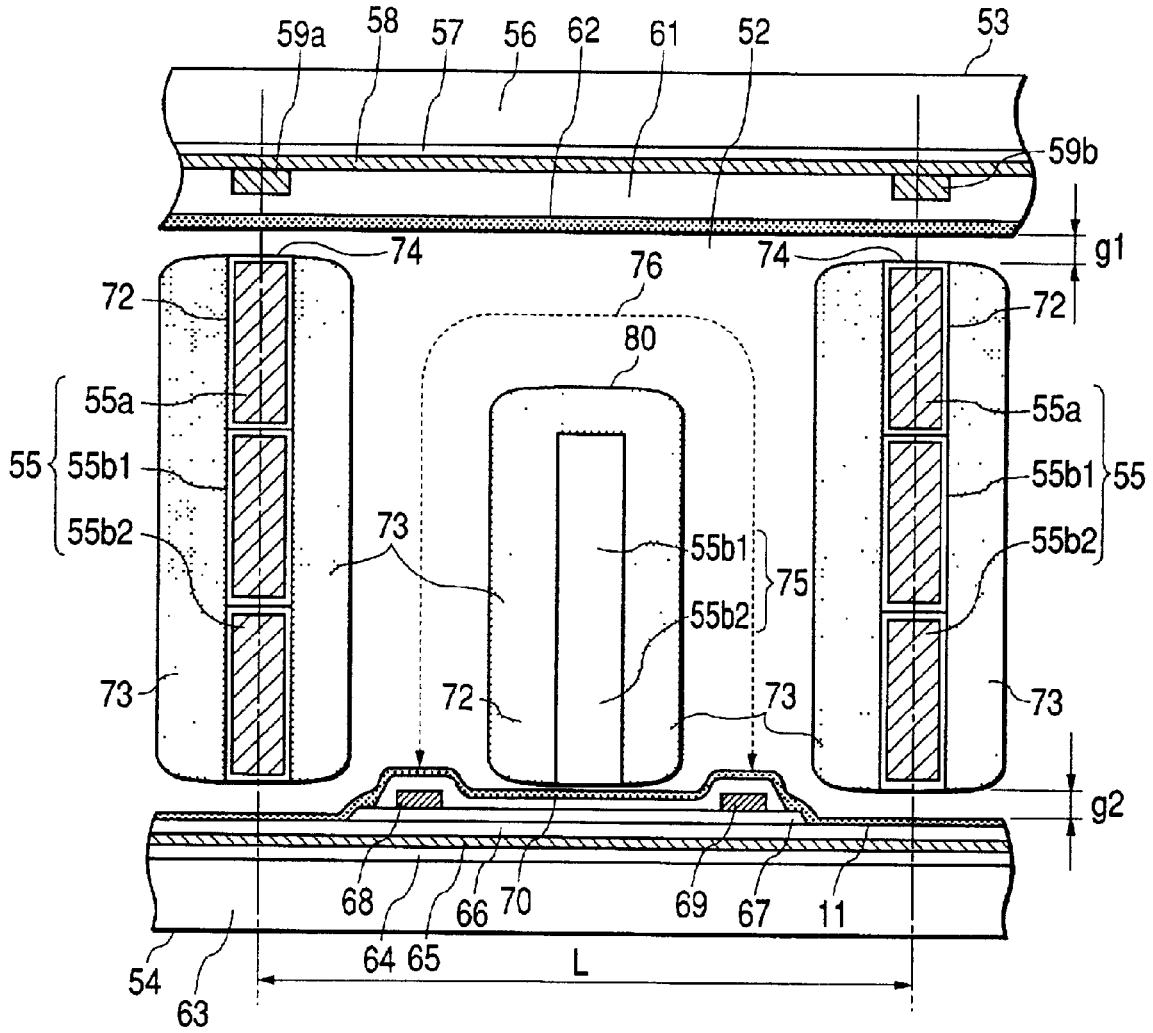
FIG. 8 is the cross-section view of a plasma display panel used in a third embodiment according to the present invention.

(C) In the display period, (1) Onto the address electrode is applied the positive short pulse voltage Va5 for use of pre-discharge (i.e., initial discharge), for ensuring the stability in the discharge, onto the first display electrode the negative sustain pulse Vy4 (=Vsus) for the display discharge, and also onto the second display electrode the positive pulse voltage Vx1 for reducing the sustain pulse voltage by forming the wall charge or wall voltage, nearly in synchronism therewith. The pulse width of the pulse voltage Va5 is selected to be equal or less than 1.0 $\mu$s, and after generating the pre-discharge, it is shifted into the discharge between the display electrode (Vy4=Vsus) and the metal electrode (VM=0), thereby forming the wall charge on the second display electrode (Vx1) of the opposing electrodes. (2) Thereafter, while applying the negative sustain pulse voltage Vx2 (=Vsus) onto the second display electrode, the positive pulse voltage Vy5 is applied onto the first display electrode, nearly in synchronism with the sustain pulse voltage Vx2. (3) Further thereafter, the negative sustain pulse voltage Vy6 for the display discharge is applied onto the first display electrode, while the positive pulse voltage Vx3 for lowering the sustain pulse through the increase of wall charge or wall voltage onto the second display electrode, nearly in synchronism with the sustain pulse voltage Vy6. In this instance, onto the address electrodes are applied the in-phase pulse voltages, for the purpose of releasing ill influence of increasing the capacity between the electrodes due to the cross structure of the A and Y electrodes shown in the FIGS. 2 and 3. Thus, the strain of the sustain voltage Vy6 to be applied onto the Y electrode is reduced in the waveform thereof, thereby achieving the low voltage and/or the short pulse of Vy6. With such the structure of the electrodes as shown in FIG. 8, which will be mentioned later, not only the Y electrode, but also the X electrode takes the cross structure, therefore it is necessary to apply the address pulse voltages in-phase, nearly in synchronism with the respective voltages Vy6 and Vx4. (4) Further thereafter, the luminous discharge for display is repeated by applying the sustain pulse voltages of Vy6 and Vx4 onto the Y and X electrodes, alternately. In this instance, Vx3 is applied to, for forming the wall charge or wall voltage, nearly in synchronism with Vy6.

(D) in the erase period, (2) Onto the first display electrode is applied the negative short pulse voltage Vy7 for neutralizing charged particles (i.e., ionized gas) on the address electrode and the first and the second display electrodes by causing the initial discharge between the metal electrode. Herein, in particular, nearly in synchronism with the pulse voltage Vy7, onto the address electrode is applied the pulse voltage Va8 for erasing the wall charge on the address electrode with certainty. However, without neutralizing the charged particles (i.e., the ionized gas) in this ease period, it is also possible to utilize them for the purpose of improvement on the contrast. In this case, the erase discharge (the thin-line pulse discharge) by means of the pulse voltage Vy7 must be shared with the initial discharge which will be caused by applying the pulse voltage onto the address electrode and the first display electrode in the all write-in period thereafter. Assuming that the time distance between the time point when the pulse voltage Vy7 is applied to in the erase period and the time point when the pulse voltage is applied to in the all write-in period is within about 50 $\mu$s, it is possible to use the charged particles in the form of the wall charges on the address electrode and the first display electrode, without neutralization of the charged particles generated in the erase discharge by the pulse voltage Vy7. For the purpose of forming the wall charge with high efficiency, it is effective to make the time distance mentioned above, sufficiently (for example, within 10 $\mu$s). In the case where no such the initial discharge occurs in the all write-in period for each the sub-field, since the number of the discharges comes down, the brightness when displaying black is lowered, thereby enabling an improvement on the darkroom contrast.

When conducting the all write-in on plural numbers of the sub-fields, since the initial discharge must be generated by conducting the all write-in in the first sub-field, pulse voltage is applied onto the address electrode and the first display electrode, which is higher than that used in the case for other sub-fields (the pulse being larger than the sum in the absolute value).

FIG. 4 is a view of the structure of a display apparatus 40 comprising the plasma display panel 20, which is driven by the drive waveforms shown in the FIG. 1.

In FIG. 4, are reference numeral 20 indicates the plasma display panel comprising the elements shown in the FIGS. 2 and 3; 25 a line of scan driver LSIs (ICs) for scanning and driving all the first display electrodes (i.e., the Y electrodes) of the panel for each the sub-field; 22 a line of address driver LSIs (ICs) for addressing the display cell of the panel for each the sub-field by driving the address electrode through the address pulse voltage; 23 an X-sustain pulse generator for generating sustain pulse for driving the second display electrode (i.e., the X electrode); 24 a Y-sustain pulse generator for generating sustain pulse for driving the first display electrode (i.e., the Y electrode); 26 a photo coupler; 21 a panel-side device including several ones mentioned above; 31 a control circuit for controlling the line of scan driver LSIs (ICs) 25, the line of address driver LSIs (ICs) 22, the X-sustain pulse generator 23, the Y-sustain pulse generator 24, and the photo coupler 26; 32 an electric power source circuit comprising a DC/DC converter therein; and 30 a controller circuit device including the control circuit 31 and the electric power source circuit 32 therein. For the purpose of overlapping the line of scan driver LSIs (ICs) 25 with the Y-sustain pulse generator 24, a floating method is applied, in which reference voltage of the Y-sustain pulse generator 24 is shifted by the control signal of the line of scan driver LSIs (ICs) 25, therefore the photo coupler 26 transmits the control signal separately, so as to supply it to the line of scan driver LSIs (ICs) 25. Also, the DC/DC converter 32 generates various kinds of voltages, which are necessary for forming the drive waveforms.

FIGS. 5(*a*) and 5(*b*) are views for explaining the principle of the display discharge in the display cell, and in particular FIG. 5(*a*) shows the waveform of the sustain voltage (i.e., sustain pulse voltage) Vsus to be applied onto the first display electrode or the second display electrode, and also the waveform of discharge current (I) caused by it, while FIG. 5(*b*) the conditions of the first display electrode (i.e., the Y electrode), the second display electrode (i.e., the X electrode), the metal electrode (i.e., the M electrode) and a discharge space (i.e., the cell) enclosed by them, in that instance.

For example, when the negative sustain voltage (i.e., the sustain pulse voltage) Vsus is applied onto the first display electrode (i.e., the Y electrode) from the condition ((1)) where the negative wall charge is formed on the surface portion of the first display electrode (i.e., the Y electrode), high electric field is established by the wall voltage Vw of forward direction bias and the electrode structure of the first display electrode (i.e., the Y electrode) and the metal electrode, therefore the discharge occurs between a portion of the metal electrode near to the first display electrode (i.e., the Y electrode) and the first display electrode (i.e., the Y electrode) itself ((2)), and it develops to discharge between the first display electrode (i.e., the Y electrode) and the second display electrode (i.e., the X electrode) while glowing up rapidly within the discharge space ((3)). Accompanying with the rapid development of discharge is formed the discharge current waveform having a quick rise-up ((2)), (3)). Next, the space charges (i.e., the ionized gas) caused by the discharge are formed on the surface portions of the second display electrode (i.e., the X electrode) and the metal electrode in the form of the wall charges and/or wall voltage, thereby effecting reverse direction bias on the discharge space (i.e., the cell). With this, the discharge declines rapidly, thereby forming the discharge current waveform having quick fall-down ((4)).

Since the sustain voltage (i.e., the sustain pulse voltage) Vsus is also applied to after completion of the discharge, the space discharges accumulated within the cell shifts onto the surface portions of the respective electrodes, so as to form the wall charges or wall voltage thereon, thereby releasing the decline of the field intensity of electric field. After the polarity is reversed, it comes to be the forward bias voltage for the sustain voltage of the X electrode, thereby the repetitive discharge ((5)) being sustained.

As was mentioned in the above, the high electric field is generated by the metal electrode structure and the forward bias voltage due to the wall charge, and this discharge glows up rapidly, thereby realizing narrow pulse discharge which declines quickly, so as to increase the strength of the UV light greatly, as well as, suppressing the decline of the field intensity by removing the space charges accumulated. With such the driving of generating the narrow pulse discharge, high brightness and high light-emission or luminous efficiency of the panel can be achieved.

Figure 6:
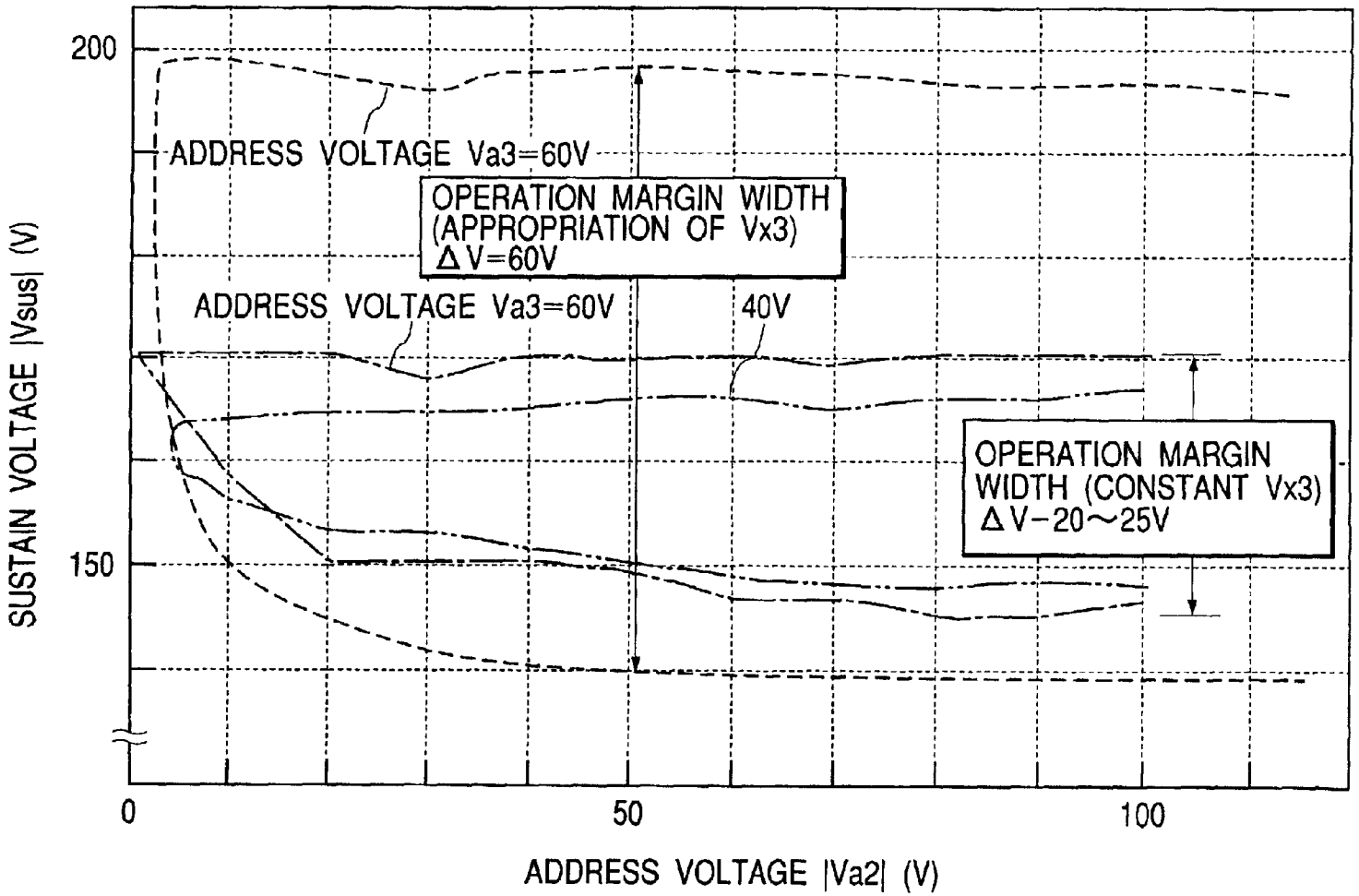
FIG. 6 is a graph for showing an operation margin characteristic of a sustain pulse for display.

FIG. 6 shows an example of a result of actual measurement on capacity or performance of the first embodiment according to the present embodiment. Herein is shown an example of the property or characteristic on operation margin of the sustain voltage |Vsus| to the address voltage |Va2| and Va3 shown in the FIG. 1. It indicates that the width of the operation margin can be increased greatly by appropriating the pulse voltage Vx3 used in the display (i.e., the sustaining) period with respect to the sustain voltage |Vsus|.

Figure 7:
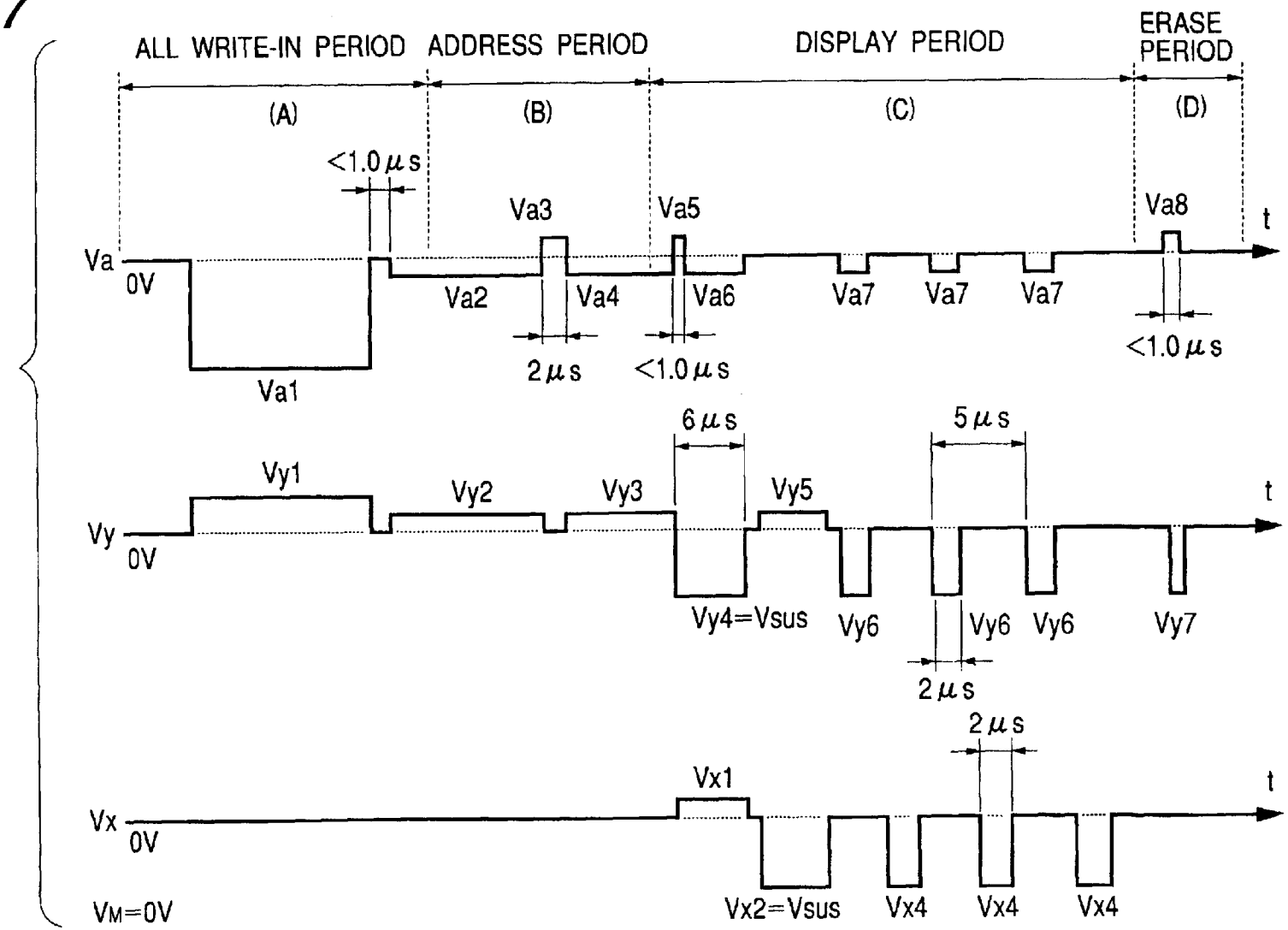
FIG. 7 is a view for showing an example of driving waveforms used in a second embodiment according to the present invention.

FIG. 7 shows an example of driving technology, as a second embodiment according to the present invention, especially in the case of performing the AC drive on the plasma display shown in the FIGS. 2 and 3, in the similar manner as in the first embodiment mentioned above. As the drive waveforms shown herein are included, being similar to the first embodiment, the drive voltage waveform of the address electrode and the drive voltage waveforms of the display electrodes, within the period of one (1) sub-field. The difference from the case shown in the FIG. 1 lies in that the positive pulse voltage Vx3 is not applied onto the second display electrode (i.e., the X electrode) when the sustain pulse voltage Vy6 is applied onto the first display electrode (i.e., the Y electrode ) in the display period (in the case of FIG. 1, the pulse voltage Vx3 is applied to.) In this FIG. 7, Va is the drive voltage to be applied onto the address electrode, Vy the drive voltage to be applied onto the first display electrode, Vx the drive voltage to be applied onto the second display electrode, and $V_M$ the voltage of the metal electrode, respectively. Also in the present second embodiment, the time-period of one (1) sub-field includes: the all write-in period ((A)) for forming the wall charges onto all the electrodes; the address period ((B)) for selecting (=addressing) a specific cell portion by changing the condition of wall charges upon the basis of the picture signal; the display period ((C)) for bringing the display cell to emit light in accordance with the selection condition (i.e., the addressing); and the erase period ((D)) for neutralizing the electric charges. In the present second embodiment, at least a piece of the metal sheets of the metal electrodes is also grounded, and therefore the voltage $V_M$ is 0v.

Figure 9:
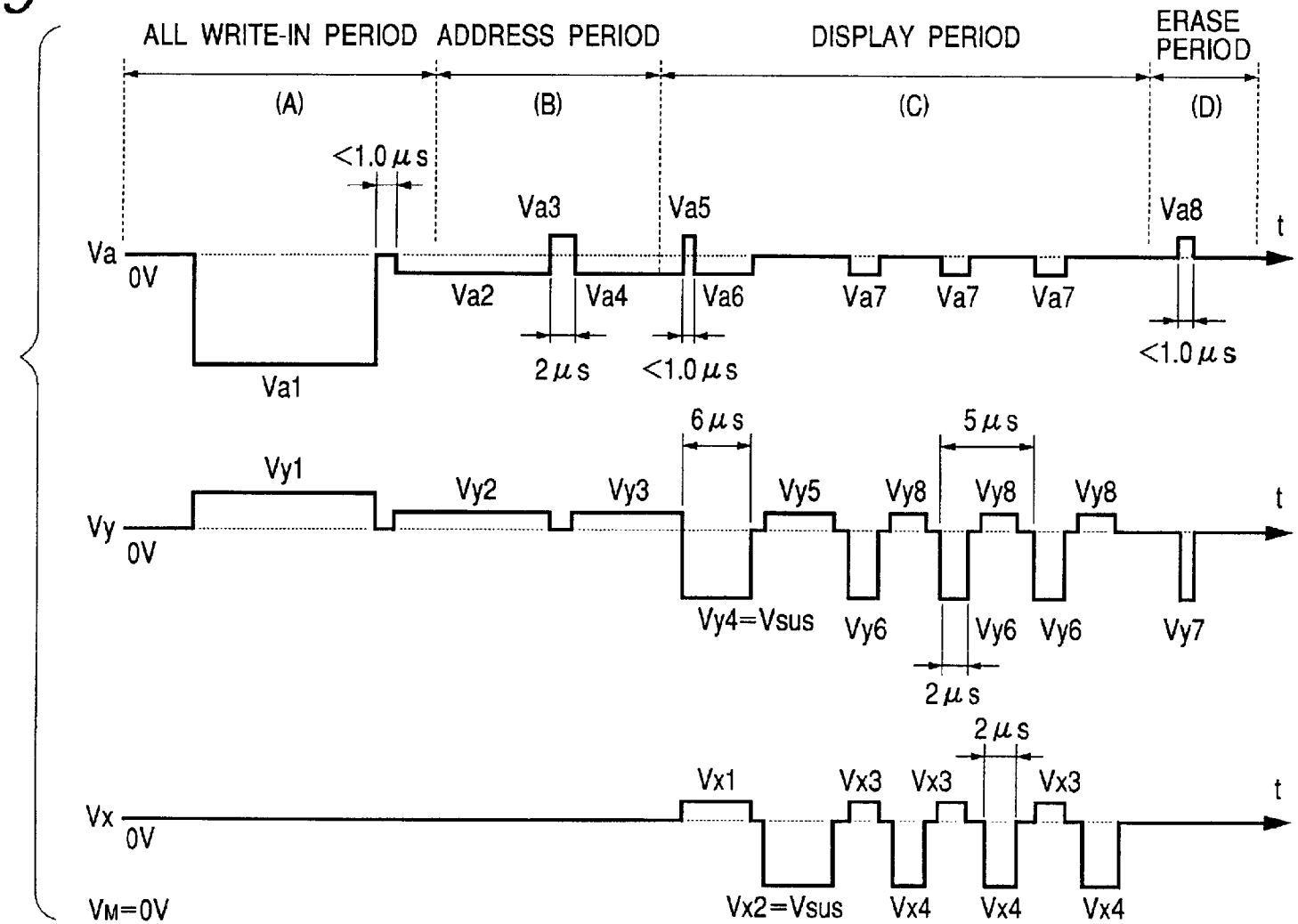
FIG. 9 is a view for showing an example of driving waveforms used in the third embodiment according to the present invention.

FIGS. 8 and 9 are views for explaining a third embodiment according to the present invention.

FIG. 8 shows an example of the cross-section structure of the plasma display panel used in the present third embodiment. In this FIG. 8, a reference numeral 65 indicates an address electrode for addressing; 68 a first display electrode (i.e., the Y electrode) being provided crossing with the address electrode at the right angles for displaying; 69 a second display electrode disposed nearly on the same plane with the first display electrode 68 and also in parallel therewith, for displaying in collaboration with the first display electrode 68; 58 a flat electrode formed from a light-transmission member or material in a plane-like shape; 59*a* and 59*b* buss electrodes piled on the flat electrode 58 and formed nearly in parallel with the first display electrode 68; 74 a partition wall provided in the lattice-like form between the side, on which the first display electrode (i.e., the Y electrode) 68 and the second display electrode (i.e., the X electrode) 69 are disposed, and the side, on which the flat electrode 58 and the bus electrodes 59*a* and 59*b* are disposed; 80 a section wall provided in the middle portion of the partition wall 74; 55*a*, 55*b*1, 55*b*2 metal electrodes provided within the partition wall 74 and the section wall 80, respectively; 63 a reverse-side glass substrate; 54 a reverse side substrate; 53 a front substrate; 56 a front glass substrate; 61, 66, 67 and 70 dielectric layers; 71 a protection layer made of MgO, $Y_2O_3$ or $RuO_2$, etc.; 72 an oxide insulation film; 73 and 62 fluophor layers; 52 a display cell portion; 57 and 64 background layers; and 76 a discharge passage. The address electrode 65, the first display electrode (i.e., the Y electrode) 68 and the second display electrode (i.e., the X electrode) 69 are formed to be applied with positive or negative voltage, and the metal electrode 55*b*2 is grounded to the earth, to be zero (0) in potential. The metal electrodes 55*a*, 55*b*1 and 55*b*2 have hole-like forms differing from one another in the kinds. As was mentioned in the above, with forming the section wall 80 lower than the partition wall 74 in the middle portion thereof, the discharge passage 76 is formed within the partition wall 74, in the form of reversed "U", laying from the first display electrode 68 up to the second display electrode 69. The length of the discharge passage 76 is greatly longer (2–3 times or more), comparing to the conventional structure, in which the first display electrode 68 and the second display electrode 69 are formed in a plane-like manner on a side of the front substrate 53, or in which they are divided into both, a side of the front substrate 53 and a side of the reverse side substrate 54, opposing to each other.

In FIG. 9 are shown drive waveforms used in case of performing the AC drive on the plasma display panel of the structure shown in the FIG. 8 mentioned above. As the drive waveforms shown herein, they include, being similar to the case of the first embodiment shown in the FIG. 1 and also to the case of the second embodiment shown in the FIG. 7, the drive voltage waveform on the address electrode and the drive voltage waveforms on the display electrodes within the period of one (1) sub-field. The difference from the case shown in the FIG. 1 lies in that positive pulse voltage Vy8 is applied onto the first display electrode (i.e., the Y electrode) when applying the sustain pulse voltage Vx4 onto the second display electrode (i.e., the X electrode), nearly in synchronism therewith (in the case shown in FIG. 1, only the pulse voltage Vx3 is applied to).

In this FIG. 9, in a case where the structures of the X and Y electrodes are about symmetry, as is shown in the FIG. 8, also Vx3 and Vy8, in addition to Vx4 and Vy6, are driven by the same voltage value. Accordingly, in general, the embodiment shown in the FIG. 7 is applied, of course, depending upon the driving condition thereof, into such the electrode structures shown in the FIG. 8, in many cases. Va shown in FIG. 9 is the drive voltage to be applied onto the address electrode 65, Vy the drive voltage to be applied onto the first display electrode (i.e., the Y electrode) 68, Vx the drive voltage to be applied onto the second display electrode (i.e., the X electrode) 69, and $V_M$ the voltage of the metal electrode, respectively. In the present third embodiment, also the time-period of one (1) sub-field includes: the all write-in period ((A)) for forming the wall charges onto all of the electrodes; the address period ((B)) for selecting (=addressing) a specific cell portion by changing the condition of wall charges upon the basis of the picture signal; the display period ((C)) for bringing the display cell to emit light in accordance with the selection condition (i.e., the addressing); and the erase period ((D)) for neutralizing the electric charges. In the present third embodiment, at least the electrode 55*b*2 of the metal electrodes is grounded to the earth. Further, according to the present third embodiment, the flat electrode 58 and the buss electrode 59*a* and 59*b*, achieving the same function as the metal electrodes, may be grounded to the earth, in a case.

According to the third embodiment mentioned above, since the light-emission or luminous area for display can be increased up, by forming the discharge passage to be long in the distance, it is possible to obtain a great improvement on the luminous efficiency and the brightness under the condition within predetermined electric power consumption. Other than that, in the similar manner in the cases of the first and the second embodiments mentioned above, the contrast of the picture can be also improved due to the address operation accompanying with no such light-emission.

However, in the plasma display panel used in the embodiments mentioned above, a specific one of a part of plural numbers of sheets of the metal electrodes, building up the partition wall or the section wall, is grounded to the earth, but other part(s) of the sheets (a singular or plural number) or all the plural numbers of sheets may be grounded. Furthermore, the metal electrodes may be built up, not in such the multi-sheet structure, but in a singular sheet structure. Also the structure of the each electrode should not be restricted only to the electrode structure used in the explanations of the embodiments mentioned above. For example, in the structure shown in the FIG. 8, for the third embodiment mentioned above, it may be so constructed that the flat electrode 58 and the buss electrodes 59*a* and 59*b* are removed for the purpose of obtaining a low cost panel. Also, as shown in the FIG. 8, even in the case where the flat electrode 58 and the buss electrodes 59*a* and 59*b* are provided, they may be so structure not to be grounded to the earth. And also, the drive waveforms shown in the FIGS. 1, 7 and 9 are only for the purpose of explanation of the present invention, therefore with the number of pulses, the pulse voltage value, the pulse width, and the pulse form (including a form other than a rectangular one), etc., they should not be restricted only to those described in the above.

Although the explanation was given in details on the present invention made by the present inventors, upon the basis of the embodiments thereof, in the above, however it is needless to say, the present invention should not be limited only to the embodiments mentioned above, and is susceptible of changes and modifications without departing from the scope of the invention.

Representative ones of aspects disclosed in the embodiments mentioned above are as follows.

(1) A driving method for a plasma display panel having an address electrode, a first display electrode formed on said address electrode, a second display electrode formed on a surface opposing to said the first display electrode, and a partition wall formed between said first display electrode and said second display electrode, comprising the following steps:

a first step for conducting addressing operation for each sub-field; and a second step for conducting sustaining operation for display upon basis of a result of said addressing, wherein, in said second step, onto said second display electrode is applied pulse voltage differing in polarity and nearly in synchronism with first sustain pulse voltage to be applied onto said first display electrode, thereby forming space charges generated after discharge between said address electrode and said first display electrode in form of wall charges on said second display electrode.

(2) A driving method for a plasma display panel having an address electrode, a first display electrode formed on said address electrode, a second display electrode formed on a surface opposing to said the first display electrode, and a partition wall formed between said first display electrode and said second display electrode and including a metal electrode therein, comprising the following steps:

a first step for conducting addressing operation for each sub-field; and a second step for conducting sustaining operation for display upon basis of a result of said addressing, wherein, in said second step, onto said second display electrode is applied pulse voltage differing in polarity and nearly in synchronism with sustain pulse voltage following after second one to be applied onto said first display electrode, thereby forming space charges generated after discharge between said first display electrode and said metal electrode in form of wall charges on said second display electrode.

(3) A driving method for a, plasma display panel having an address electrode, a first display electrode formed on said address electrode, a second display electrode formed on a surface opposing to said the first display electrode, and a partition wall formed between said first display electrode and said second display electrode and including a metal electrode therein, comprising the following steps:

a first step for conducting addressing operation for each sub-field; and a second step for conducting sustaining operation for display upon basis of a result of said addressing, wherein, in said second step, onto said first display electrode is applied pulse voltage differing in polarity and nearly in synchronism with first sustain pulse voltage to be applied onto said second display electrode, thereby forming space charges generated after discharge between said second display electrode and said metal electrode in form of wall charges on said first display electrode.

(4) A driving method for a plasma display panel having an address electrode, a first display electrode formed on said address electrode, a second display electrode formed on a surface opposing to said the first display electrode, and a partition wall formed between said first display electrode and said second display electrode and including a metal electrode therein, comprising the following steps:

a first step for conducting addressing operation for each sub-field; and a second step for conducting sustaining operation for display upon basis of a result of said addressing, wherein, in said second step, onto said first display electrode is applied pulse voltage differing in polarity and nearly in synchronism with sustain pulse voltage following after second one to be applied onto said second display electrode, thereby forming space charges generated after discharge between said second display electrode and said metal electrode in form of wall charges on said first display electrode.

(5) A driving method for a plasma display panel having an address electrode, a first display electrode formed on said address electrode, a second display electrode formed on a surface opposing to said the first display electrode, and a partition wall formed between said first display electrode and said second display electrode and including a metal electrode therein, comprising the following steps:

a first step for conducting addressing operation for each sub-field; and a second step for conducting sustaining operation for display upon basis of a result of said addressing, wherein, in said second step, onto said second display electrode is applied pulse voltage differing in polarity and nearly in synchronism with first sustain pulse voltage to be applied onto said first display electrode, thereby forming space charge generated after discharge between said address electrode and said first display electrode in form of wall charge on said second display electrode; and onto said first display electrode is applied pulse voltage differing in polarity and nearly in synchronism with the first sustain pulse voltage to be applied onto said second display electrode, thereby forming space charge generated after discharge between said second display electrode and said metal electrode in form of wall charge on said first display electrode.

(6) A driving method for a plasma display panel having an address electrode, a first display electrode formed on said address electrode, a second display electrode formed on a surface opposing to said the first display electrode, and a partition wall formed between said first display electrode and said second display electrode and including a metal electrode therein, comprising the following steps:

a first step for conducting addressing operation for each sub-field; and a second step for conducting sustaining operation for display upon basis of a result of said addressing, wherein, in said second step, onto said second display electrode is applied pulse voltage differing in polarity and nearly in synchronism with first sustain pulse voltage to be applied onto said first display electrode, thereby forming space charge generated after discharge between said address electrode and said first display electrode in form of wall charge on said second display electrode; and onto said second display electrode is applied pulse voltage differing in polarity and nearly in synchronism with sustain pulse voltage following after second one to be applied onto said first display electrode, thereby forming space charge generated after discharge between said first display electrode and said metal electrode in form of wall charge on said second display electrode.

(7) A driving method for a plasma display panel having an address electrode, a first display electrode formed on said address electrode, a second display electrode formed on a surface opposing to said the first display electrode, and a partition wall formed between said first display electrode and said second display electrode and including a metal electrode therein, comprising the following steps:

a first step for conducting addressing operation for each sub-field; and a second step for conducting sustaining operation for display upon basis of a result of said addressing, wherein, in said second step, onto said second display electrode is applied pulse voltage differing in polarity and nearly in synchronism with first sustain pulse voltage to be applied onto said first display electrode, thereby forming space charge generated after discharge between said address electrode and said first display electrode in form of wall charge on said second display electrode; onto said first display electrode is applied pulse voltage differing in polarity and nearly in synchronism with the first sustain pulse voltage to be applied onto said second display electrode, thereby forming space charge generated after discharge between said second display electrode and said metal electrode in form of wall charge on said first display electrode; and onto said second display electrode is applied pulse voltage differing in polarity and nearly in synchronism with sustain pulse voltage following after second one to be applied onto said first display electrode, thereby forming space charge generated after discharge between said first display electrode and said metal electrode in form of wall charge on said second display electrode.

(8) A driving method for a plasma display panel having an address electrode, a first display electrode formed on said address electrode, a second display electrode formed on a surface opposing to said the first display electrode, and a partition wall formed between said first display electrode and said second display electrode and including a metal electrode therein, comprising the following steps:

a first step for conducting addressing operation for each sub-field; and a second step for conducting sustaining operation for display upon basis of a result of said addressing, wherein, in said second step, onto said second display electrode is applied pulse voltage differing in polarity and nearly in synchronism with first sustain pulse voltage to be applied onto said first display electrode, thereby forming space charge generated after discharge between said address electrode and said first display electrode in form of wall charge on said second display electrode; onto said first display electrode is applied pulse voltage differing in polarity and nearly in synchronism with the first sustain pulse voltage to be applied onto said second display electrode, thereby forming space charge generated after discharge between said second display electrode and said metal electrode in form of wall charge on said first display electrode; onto said second display electrode is applied pulse voltage differing in polarity and nearly in synchronism with sustain pulse voltage following after second one to be applied onto said first display electrode, thereby forming space charge generated after discharge between said first display electrode and said metal electrode in form of wall charge on said second display electrode; and onto said first display electrode is applied pulse voltage differing in polarity and nearly in synchronism with sustain pulse voltage following after the second one to be applied onto said second display electrode, thereby forming space charge generated after discharge between said second display electrode and said metal electrode in form of wall charge on said first display electrode.

(9) A driving method for a plasma display panel, described in any one of the above (1) to (8), wherein in said second step, onto said address electrode is applied short pulse voltage, being different in polarity, at a time earlier than rise-up of the first sustain pulse voltage to be applied onto said first display electrode.

(10) A driving method for a plasma display panel, described in any one of the above (1) to (8), wherein in said second step, nearly in synchronism with the sustain pulse voltage to be applied onto said first display electrode, onto said address electrode is applied pulse voltage, being same in polarity, for reducing an influence of capacity between said address electrode upon said first display electrode.

(11) A driving method for a plasma display panel, described in any one of the above (1) to (8), wherein in said first step, said address electrode and said first display electrode are formed on a same plane, and the address pulse voltage onto said address electrode upon basis of a picture signal and scan pulse voltage onto said first display electrode are applied nearly in synchronism therewith, so as to remove the wall charge formed in advance on both the electrodes without accompanying luminous discharge, thereby selecting a non-luminous cell(s).

(12) A driving method for a plasma display panel, described in any one of the above (1) to (8), wherein in said second step, onto either one or both of said first and second electrodes is applied the first sustain pulse voltage, corresponding thereto respectively, and as the sustain pulse voltage following after the second one is applied sustain pulse voltage, being narrower in pulse width than that of said first sustain pulse voltage.

(13) A driving method for a plasma display panel having an address electrode, a first display electrode formed on said address electrode, a second display electrode formed on a surface opposing to said the first display electrode, and a partition wall formed between said first display electrode and said second display electrode and including a metal electrode therein, comprising the following steps:

a first step for plural numbers of sub-fields to conduct all write-in, respectively;

a second step for conducting addressing operation;

a third step for conducting sustaining operation; and a fourth step for conduction erase operation, wherein, in said first step, wall charge is formed through initial discharge caused by applying pulse voltages onto said address electrode and said first display electrode, respectively, and by causing self-erase discharge after said pulse voltages are removed, wall charge is formed by applying voltages onto said address electrode and said first display electrode, respectively;

in said second step, address pulse voltage is applied onto said address electrode upon basis of the picture signal, nearly in synchronism with scan pulse voltage onto said first display electrode, so as to remove said wall charge without accompanying luminous discharge, thereby selecting a non-luminous cell(s);

in said third step, onto a luminous cell(s) selected through forming said wall charge, short-pulse voltage is applied onto said address electrode and sustain pulse voltage onto said first display electrode, so as to cause pre-discharge, and thereafter, by means of the sustain pulse voltages applied onto said first display electrode and said second display electrode alternately, display luminous discharge is repeated through the initial discharge between said metal electrode grounded to the earth, thereby applying a last sustain pulse voltage onto said second display electrode; and in said fourth step, only onto said first display electrode, or onto said first display electrode and said address electrode, respectively, thin-line short-pulse voltage is applied, thereby causing discharge for erasing the wall charge between said metal electrode, said address electrode, and said second display electrode.

(14) A driving method for a plasma display panel, as described in the above (13), wherein, in said first step, onto said address electrode and said first display electrode are applied the short-pulse voltages being different in polarity for generating the space charge through the initial discharge and long-pulse voltages being different in polarity for forming the wall charge, respectively, generating self-erase discharge after removal of said long-pulse voltages, voltages are applied onto said address electrode and said first display electrode, respectively, thereby forming the wall charge.

(15) A driving method f or a plasma display panel, as described in the above (14), wherein, in said first step, sum of the voltages, being applied onto said address electrode and said first display electrode, respectively, in absolute value thereof, is made larger in case of said short-pulse voltage than that in case of said long-pulse voltage.

(16) A driving method for a plasma display panel, as described in the above (14) or (15), wherein at least one of said plural numbers of sub-fields causes the space charge with using said short-pulse voltage in said first step, while in remaining sub-field(s) using no such the short-pulse voltage is shared in common the space charge, which is caused by said thin-line short pulse voltage applied only onto said first display electrode, or onto said first display electrode and said address electrode, respectively, in said fourth step.

(17) A driving method for a plasma display panel, as described in the above (13), wherein in said third step, during repetition of the display luminous discharge through the initial discharge between said metal electrode grounded to the earth by means of the sustain pulse voltage, being applied onto said first display electrode and said second display electrode, alternately, onto said second display electrode is applied pulse voltage, being different in polarity and nearly in synchronism with the sustain pulse voltage to be applied onto said first display electrode, thereby forming the space charge generated after the discharge between said address electrode or said metal electrode and said first display electrode, in form of wall charge on said second display electrode, and onto said first display electrode is applied pulse voltage, being different in polarity and nearly in synchronism with the sustain pulse voltage to be applied onto said second display electrode, thereby forming the space charge generated after the discharge between said second display electrode and said address electrode, in form of wall charge on said first display electrode.

(18) A driver circuit for a plasma display panel having an address electrode, a first display electrode formed on said address electrode, a second display electrode formed on a surface opposing to said the first display electrode, and a partition wall formed between said first display electrode and said second display electrode and including a metal electrode therein, comprising:

a first driver circuit for driving said address electrode by address pulse voltage;

a second driver circuit for driving said first display electrode by Y scan pulse voltage and sustain pulse voltage;

a third driver circuit for driving said second display electrode by sustain pulse voltage; and a controller circuit for controlling said first, second and third driver circuits, wherein, said third driver circuit is so constructed as to apply pulse voltage onto said second display electrode, nearly in synchronism with the sustain pulse voltage to be applied onto said first display electrode, for forming space charge generated after discharge between said first display electrode and said metal electrode, in form of wall charge on said second display electrode.

(19) A driver circuit for a plasma display panel having an address electrode, a first display electrode formed on said address electrode, a second display electrode formed on a surface opposing to said the first display electrode, and a partition wall formed between said first display electrode and said second display electrode and including a metal electrode therein, comprising:

a first driver circuit for driving said address electrode by address pulse voltage;

a second driver circuit for driving said first display electrode by Y scan pulse voltage and sustain pulse voltage;

a third driver circuit for driving said second display electrode by sustain pulse voltage; and a controller circuit for controlling said first, second and third driver circuits, wherein, said second driver circuit is so constructed as to apply pulse voltage onto said first display electrode, nearly in synchronism with the sustain pulse voltage to be applied onto said second display electrode, for forming space charge generated after discharge between said second display electrode and said metal electrode, in form of wall charge on said first display electrode.

(20) A driver circuit for a plasma display panel having an address electrode, a first display electrode formed on said address electrode, a second display electrode formed on a surface opposing to said the first display electrode, and a partition wall formed between said first display electrode and said second display electrode and including a metal electrode therein, comprising:

a first driver circuit for driving said address electrode by address pulse voltage;

a second driver circuit for driving said first display electrode by Y scan pulse voltage and sustain pulse voltage;

a third driver circuit for driving said second display electrode by sustain pulse voltage; and a controller circuit for controlling said first, second and third driver circuits, wherein, said third driver circuit is so constructed as to apply pulse voltage onto said second display electrode, nearly in synchronism with the sustain pulse voltage to be applied onto said first display electrode, for forming space charge generated after discharge between said first display electrode and said metal electrode, in form of wall charge on said second display electrode, and said second driver circuit is so constructed as to apply pulse voltage onto said first display electrode, nearly in synchronism with the sustain pulse voltage to be applied onto said second display electrode, for forming space charge generated after discharge between said second display electrode and said metal electrode, in form of wall charge on said first display electrode.

(21) A driver circuit for a plasma display panel, as described in any one of the above (18) to (20), wherein said first driver circuit is so constructed as to apply pulse voltage onto said address electrode, in nearly synchronism with the sustain voltage to be applied onto said first display electrode, for reducing influence of capacity between said address electrode and said first display electrode.

(22) A display apparatus comprising:

a plasma display panel, having a metal electrode disposed between first and second display electrodes (Y electrode, X electrode), each having a portion crossing with and in nearly parallel with an address electrode (A electrode), and partition wall provided in a lattice-like from; and a driver circuit for the plasma display panel, which is described in any one of the above (18) to (20).

Also, according to the present invention, all of being applicable thereto, for example, also a display apparatus for use in a computer, also, a flat-panel type television, a display apparatus for use of information display, such as, an advertisement and others, a presentation apparatus for use in an explanation, etc., is included within the breadth or region of the present invention.

With the representative ones of the present invention disclosed in the present application, it is possible to obtain any one or all of the following effects (1) to (3):

(1) It is possible to obtain an improvement on the luminous efficiency and/or the brightness, in the plasma display panel, etc;

(2) It is possible to obtain high-speed operation of the address operation and/or the sustaining operation, in the plasma display panel, etc.; and (3) It is possible to obtain reductions in voltage and electric power consumption, a stability of display discharge, and an improvement on the contrast, as well, in the plasma display panel, etc.

What is claimed is:

1. A driving method for a plasma display panel, having an address electrode, a first display electrode formed on said address electrode, a second display electrode formed on a surface opposing to said the first display electrode, and a partition wall formed between said first display electrode and said second display electrode and including a metal electrode therein, comprising:

conducting an addressing operation for each sub-field; and conducting a sustaining operation for display upon basis of a result of said addressing;

wherein, in conducting said sustaining operation, onto said second display electrode is applied pulse voltage differing in polarity and nearly in synchronism with sustain pulse voltage following after second one to be applied onto said first display electrode; thereby forming space charges generated after discharge between said first display electrode and said metal electrode in form of wall charges on said second display electrode; and wherein in conducting said sustaining operation, onto said address electrode is applied short pulse voltage, being different in polarity, at a time earlier than rise-up of the first sustain pulse voltage to be applied onto said first display electrode.

2. A driving method for a plasma display panel, having an address electrode, a first display electrode formed an said address electrode, a second display electrode formed on a surface opposing to said the first display electrode, and a partition wall formed between said first display electrode and said second display electrode and including a metal electrode therein, comprising:

conducting an addressing operation for each sub-field; and conducting a sustaining operation for display upon basis of a result of said addressing:

wherein, in conducting said sustaining operation, onto said first display electrode is applied pulse voltage differing in polarity and nearly in synchronism with first sustain pulse voltage to be applied onto said second display electrode, thereby forming space charges generated after discharge between said second display electrode and said metal electrode in form of wall charges on said first display electrode; and wherein in conducting said sustaining operation, onto said address electrode is applied short pulse voltage, being different in polarity, at a time earlier than rise-up of the first sustain pulse voltage to be applied onto said first display electrode.

3. A driving method for a plasma display panel having an address electrode, a first display electrode formed on said address electrode, a second display electrode formed on a surface opposing to said the first display electrode, and a partition wall formed between said first display electrode and said second display electrode and including a metal electrode therein, comprising:

conducting all write-in, respectively, by plural numbers of sub-fields;

conducting an addressing operation;

conducting a sustaining operation; and conducting an erase operation, wherein, in conducting said all write-in, a wall charge is formed through initial discharge caused by applying pulse voltages onto said-address electrode and said first display electrode, respectively, and by causing self-erase discharge after said pulse voltages are removed, wall charge is formed by applying voltages onto said address electrode and said first display electrode, respectively;

in conducting said addressing operation, an address pulse voltage is applied onto said address electrode upon basis of the picture signal, in synchronism with scan pulse voltage onto said first display electrode, so as to remove said wall charge without accompanying luminous discharge, thereby selecting a non-luminous cell (s);

in conducting said sustaining operation, onto a luminous cell(s) selected through forming said wall charge, short-pulse voltage is applied onto said address electrode and sustain pulse voltage onto said first display electrode, so as to cause pre-discharge, and thereafter, by means of sustain pulse voltages applied onto said first display electrode and said second display electrode alternately, display luminous discharge is repeated through the initial discharge between said metal electrode grounded to the earth, thereby applying a last sustain pulse voltage onto said second display electrode; and in conducting said erase operation, only onto said first display electrode, or onto said first display electrode and said address electrode, respectively, thin-line short pulse voltage is applied, thereby causing discharge for erasing the wall charge between said metal electrode, said address electrode, and said second display electrode.

4. A driving method for a plasma display panel, as described in the claim 3, wherein, in conducting said all write-in, onto said address electrode and said first display electrode are applied the short-pulse voltages being different in polarity for generating the space charge through the initial discharge and long-pulse voltages being different in polarity for forming the wall charge, respectively, generating self-erase discharge after removal of said long-pulse voltages, voltages are applied onto said address electrode and said first display electrode, respectively, thereby fanning the wall charge.

5. A driving method for a plasma display panel, as described in the claim 4, wherein, in conducting said all write-in, a sum of the voltages, being applied Onto said address electrode and said first display electrode, respectively, in absolute value thereof, is made larger in case of said short-pulse voltage than that in case of said long-pulse voltage.

6. A driving method for a plasma display panel, as described in the claim 4, wherein at least one of said plural numbers of sub-fields causes the space charge with using said short-pulse voltage in conducting said all write-in, while in remaining sub-field(s) using no such the short-pulse voltage is shared in common the space charge, which is caused by said thin-line short pulse voltage applied only onto said first display electrode, or onto said first display electrode and said address electrode, respectively, in conducting said erase operation.

7. A driving method for a plasma display panel, as described in the claim 3, wherein in conducting said sustaining operation, during repetition of the display luminous discharge through the initial discharge between said metal electrode grounded to the earth by means of the sustain pulse voltage, being applied onto said first display electrode and said second display electrode, alternately, onto said second display electrode is applied pulse voltage, being different in polarity and in synchronism with the sustain pulse voltage to be applied onto said first display electrode, thereby forming the space charge generated after the discharge between said address electrode or said metal electrode and said first display electrode, in form of wall charge on said second display electrode, and onto said first display electrode is applied pulse voltage, being different in polarity and in synchronism with the sustain pulse voltage to be applied onto said second display electrode, thereby forming the space charge generated after the discharge between said second display electrode and said address electrode, in form of wall charge on said first display electrode.

8. A plasma display apparatus, comprising:

a front substrate;

a reverse-side substrate;

a partition wall;

dielectric layers, each being formed on said front surface, said reverse side surface and said partition wall, respectively;

a fluophor layer, being formed within a region surrounded by said front surface, said reverse-side surface and said partition wall; and electrodes for bringing said fluophor layer to generate ultraviolet rays therefrom, including an address electrode, a first electrode crossing over said address electrode, a second electrode, and a third electrode, wherein a first period for conducting an addressing operation for each sub-field and a second period for conducting a sustaining operation for display upon basis of a result of said addressing, during said first period, an electric potential is generated between said address electrode and said first electrode;

during said second period, a sustain pulse voltage is generated across one of those electrodes, being defined between said first electrode and said second electrode or between said second electrode and said third electrode, in a form of potential difference therebetween, while generating a potential difference upon other of those electrodes, being reverse to polarity of said sustain pulse voltage, during said sustain pulse voltage is generated.

9. The plasma display apparatus, as defined in the claim 8, wherein the potential difference is generated between said first electrode and said second electrode and between said second electrode and said third electrode, alternately, in the form of said sustain voltage.

10. The plasma display apparatus, as defined in the claim 8, wherein a pulse is applied onto said address electrode, being same in polarity to that which is applied onto said first electrode, during the period when the potential difference is generated between said first electrode and said second electrode in the form of said sustain pulse voltage.

11. The plasma display apparatus, as defined in the claim 8, wherein a wall charge is increased due to the potential difference, which is generated between said second electrode and said third electrode.

12. The plasma display apparatus, as defined in the claim 8, wherein said second electrode is a metal partition wall, on a side surface of which is formed a dielectric layer.

13. The plasma display apparatus, as defined in the claim 8, wherein during said second period:

a negative sustain pulse voltage is applied onto said first electrode and said second electrode, alternately, while conduction an anode drive upon said second electrode; and a positive voltage is applied onto other electrode, on which no said sustain pulse voltage is applied, during the period when said sustain pulse voltage is applied onto either one of said first electrode and said third electrode.

14. The plasma display apparatus, as defined in the claim 8, wherein during said second period:

a negative sustain pulse voltage is applied onto said first electrode;

an anode drive is conducted upon said second electrode; and a positive voltage is applied onto said third electrode during a period when said sustain pulse voltage is applied onto said first electrode.

15. The plasma display apparatus, as defined in the claim 8, wherein during said second period:

a first sustain pulse of negative sustain pulse voltage is applied onto said first electrode;

an anode drive is conducted upon said second electrode; and a positive voltage is applied onto said third electrode during a period when said sustain pulse voltage is applied onto said first electrode.

16. The plasma display apparatus, as defined in the claim 8, wherein during said second period:

sustain pulse voltages including a second one and those following thereafter are applied onto said first electrode as the sustain pulses thereof;

an anode drive is conducted upon said second electrode; and a positive voltage is applied onto said first electrode during a period when said sustain pulse voltage is applied onto said third electrode.

* * * * *